US007042420B2

(12) United States Patent
Ebling et al.

(10) Patent No.: US 7,042,420 B2
(45) Date of Patent: May 9, 2006

(54) MULTI-BEAM ANTENNA

(75) Inventors: James P. Ebling, Ann Arbor, MI (US); Gabriel M. Rebeiz, Ann Arbor, MI (US); Bernhard Schoenlinner, Trostberg (DE)

(73) Assignee: Automotive Systems Laboratory, Inc., Farmington Hills, MI (US)

( * ) Notice: Subject to any disclaimer, the term of this patent is extended or adjusted under 35 U.S.C. 154(b) by 167 days.

(21) Appl. No.: 10/604,716

(22) Filed: Aug. 12, 2003

(65) Prior Publication Data

US 2005/0068251 A1 Mar. 31, 2005

Related U.S. Application Data

(63) Continuation-in-part of application No. 10/202,242, filed on Jul. 23, 2002, now Pat. No. 6,606,077, which is a continuation-in-part of application No. 09/716,736, filed on Nov. 20, 2000, now Pat. No. 6,424,319.

(60) Provisional application No. 60/166,231, filed on Nov. 18, 1999.

(51) Int. Cl.
*H01Q 15/02* (2006.01)
*H01Q 15/24* (2006.01)

(52) U.S. Cl. ..... 343/911 L; 343/911 R

(58) Field of Classification Search ..... 343/755, 343/853, 909, 911 I, 911 R, 753, 754, 700 MS
See application file for complete search history.

(56) References Cited

U.S. PATENT DOCUMENTS

| | | | | |
|---|---|---|---|---|
| 3,683,379 A | 8/1972 | Saddler et al. | ..... | 343/7 ED |
| 3,761,936 A | 9/1973 | Archer et al. | ..... | 343/754 |
| 3,972,043 A | 7/1976 | Locus | ..... | 343/756 |
| 4,222,054 A | 9/1980 | Capps | ..... | 343/754 |
| 4,268,831 A | 5/1981 | Valentino et al. | ..... | 343/754 |
| 4,288,795 A | 9/1981 | Shelton | ..... | 343/754 |

(Continued)

FOREIGN PATENT DOCUMENTS

| | | |
|---|---|---|
| EP | 0 483 686 B1 | 4/1996 |
| WO | WO 92/13373 | 8/1992 |
| WO | WO 01/37374 A1 | 5/2001 |

OTHER PUBLICATIONS

Wu, X. et al., "Design and Characterization of Single and Multiple Beam MM–Wave Circularly Polarized Substrate Lens Antennas for Wireless Communications", IEEE Antennas and Propagation Society International Symposium, 1999 Digest, APS, Orlando, Florida, Jul. 11–16, 1999, New York, NY : IEEE, US, vol. 4, Jul. 1999, Jul. 11, 1999, pp. 2408–2411, XP000935569, ISBN: 0–7803–5640–3.

W. Burnham; J. Eddy; S. Gaboury; G. Ross, *A Product Development Process View of Automotive Pre–Crash Safety Systems*, Masters of Science in Product Development Thesis, University of Detroit Mercy, Feb. 7, 2003, 235 pages.

Supplementary European Search Report in European Application No. EP 00 98 0567, Jul. 1, 2004, 3 pp.

(Continued)

*Primary Examiner*—Hoanganh Le
*Assistant Examiner*—Minh Dieu A
(74) *Attorney, Agent, or Firm*—Raggio & Dinnin, P.C.

(57) ABSTRACT

A multi-beam antenna comprises at least one curved surface, at least one dielectric substrate, and a plurality of end-fire antenna feed elements on the dielectric substrate. The at least one curved surface may be either reflective, refractive or diffractive. |Electromagnetic waves launched from the antenna feed elements are directed at the at least one curved surface, and are either reflected, refracted or diffracted thereby. n one embodiment, the substraFigureste is located within a light assembly, e.g. a vehicle headlight, wherein at least one source of light is operatively associated with the dielectric substrate, and the at least one curved surface comprises the concave optical reflector of the light assembly.

28 Claims, 13 Drawing Sheets

U.S. PATENT DOCUMENTS

| | | | | | |
|---|---|---|---|---|---|
| 4,638,322 | A | | 1/1987 | Lamberty | 343/761 |
| 4,641,144 | A | | 2/1987 | Prickett | 343/754 |
| 4,845,507 | A | | 7/1989 | Archer et al. | 343/754 |
| 4,983,237 | A | | 1/1991 | Alfing | 156/83 |
| 5,099,253 | A | | 3/1992 | Archer | 343/754 |
| 5,204,686 | A | | 4/1993 | Petrelis et al. | 342/374 |
| 5,255,004 | A | | 10/1993 | Berkowitz et al. | 343/853 |
| 5,264,859 | A | | 11/1993 | Lee et al. | 343/754 |
| 5,274,389 | A | | 12/1993 | Archer et al. | 343/754 |
| 5,313,213 | A | | 5/1994 | Neumann et al. | 342/165 |
| 5,347,287 | A | | 9/1994 | Speciale | 342/375 |
| 5,420,595 | A | | 5/1995 | Zhang et al. | 342/368 |
| 5,446,470 | A | | 8/1995 | Avignon et al. | 343/713 |
| 5,451,969 | A | | 9/1995 | Toth et al. | 343/781 CA |
| 5,486,832 | A | | 1/1996 | Hulderman | 342/70 |
| 5,548,294 | A | | 8/1996 | Sturza | 342/372 |
| 5,576,721 | A | | 11/1996 | Hwang et al. | 343/753 |
| 5,583,511 | A | | 12/1996 | Hulderman | 342/175 |
| 5,712,643 | A | | 1/1998 | Skladany | 343/700 MS |
| 5,745,082 | A | | 4/1998 | Alder | 343/753 |
| 5,821,908 | A | | 10/1998 | Sreenivas | 343/911 R |
| 5,828,344 | A | * | 10/1998 | Alder et al. | 343/755 |
| 5,874,915 | A | | 2/1999 | Lee et al. | 342/375 |
| 5,892,487 | A | | 4/1999 | Fujimoto et al. | 343/840 |
| 5,894,288 | A | | 4/1999 | Lee et al. | 343/770 |
| 5,913,549 | A | | 6/1999 | Skladany | 29/600 |
| 5,926,134 | A | | 7/1999 | Pons et al. | 342/368 |
| 5,933,109 | A | | 8/1999 | Tohya et al. | 342/175 |
| 5,959,578 | A | | 9/1999 | Kreutel, Jr. | 342/373 |
| 5,963,172 | A | | 10/1999 | Pfizenmaier et al. | 343/721 |
| 6,031,483 | A | | 2/2000 | Urabe et al. | 342/70 |
| 6,031,501 | A | * | 2/2000 | Rausch et al. | 343/754 |
| 6,037,894 | A | | 3/2000 | Pfizenmaier et al. | 342/70 |
| 6,043,772 | A | | 3/2000 | Voigtlaender et al. | 342/70 |
| 6,046,703 | A | | 4/2000 | Wang et al. | 343/795 |
| 6,061,035 | A | | 5/2000 | Kinasewitz et al. | 343/853 |
| 6,137,434 | A | | 10/2000 | Tohya et al. | 342/70 |
| 6,424,319 | B1 | | 7/2002 | Ebling et al. | 343/911 |
| 6,590,544 | B1 | * | 7/2003 | Filipovic | 343/753 |
| 6,606,077 | B1 | * | 8/2003 | Ebling et al. | 343/911 L |

OTHER PUBLICATIONS

Communication pursuant to Article 96(2) EPC in European Application No. EP 00 98 0567.2 –2220 Oct. 25, 2004 in respect of examination results (3 pages), including all claims (1–10) of European Application No. EP 00 98 0567.2 (2 pages).

G. Bekefi, and G. W. Farnell, "A homogenous dielectric sphere as a mi–crowave lens," Canadian Journal of Physics, vol. 34, pp. 790–803, 1956.

G. Toraldo di Francia, "Spherical lenses for infrared and microwaves," Journal of Applied Physics, vol. 32, pp. 2051, 1961.

Tomos L. Ap Rhys, "The design of radially symmetric lenses," IEEE Trans. on Antennas and Propagation, AP–18, pp. 497–506, Jul. 1970.

L. C. Gunderson, "An electromagnetic analysis of a cylindrical homoge–nous lens," IEEE Trans. on Antennas and Propagation, AP–20, pp. 476–479, Jul. 1972.

S. Lee, M. S. Sheshadri, V. Jamnejad, and R. Mittra, "Refraction at a curved dielectric interface: geometrical optics solution," IEEE Trans. on Microwave Theory and Techniques, MTT–30, No. 1, pp. 12–19, Jan. 1982.

M. N. Afsar, "Dielectric measurements of common polymers at millimeter wavelength range," in IEEE MTT–S Digest, pp. 439–442,1985.

J. Ashkenazy, E. Levine, and D. Treves, "Radiometric measurement of antenna efficiency," in Electron. Lett., vol. 21, No. 3, pp. 111–112, Jan. 1985.

K. S. Yngvesson, T. L. Korzeniowski, Y. S. Kim, E. L. Kollberg, and J. F. Johansson, "The tapered slot antenna—a new integrated element for mm–wave applications," IEEE Trans. on Microwave Theory and Techniques, MTT–37, No. 2, pp. 365–374, Feb. 1989.

J. Sanford, "A luneberg–lens update," IEEE Antennas and Propagation Magazine, vol. 37, No. 1, pp. 76–79, 1995.

S. Sugawara, Y. Maita, K. Adachi, K. Mori, and K. Mizuno, "A mm–wave tapered slot antenna with improved radiation pattern," in 1997 IEEE MTT–S Int. Micorwave Symp. Dig., Anaheim, CA, Jun. 1997, pp. 959–962.

K. K. Chan, S. K. Rao, G. A. Morin, and M. Q. Tang, "Triangular ray–tube analysis of dielectric lens antennas," IEEE Trans. on Antennas and Propagation, vol. 45, No. 8, pp. 1277–1285, Aug. 1997.

F. Demmerle, S. Kern, and W. Wiesbeck, "A bi–conical multibeam antenna for space division multiple access," in Antennas and Propagation Society International Symposium, Montreal, Aug. 1997, pp. 1082–1085.

H. Mosallaei, and Yahya Rahmat–Samii "Nonuniform luneberg and two–shell lens antennas: radiation characteristics and design optimization," IEEE Trans. on Antennas and Propagation, vol. 49, No. 1, pp. 60–68, Jan. 2001.

I. Gresham, N. Jain, T. Budka, A. Alexnian, N. Kinayman, B. Ziegner, S. Brown, and P. Staecker, "A compact manufactureable 76–77–GHz radar module for commercial ACC applications," IEEE Trans. on Microwave Theory and Techniques, vol. 49, No. 1, pp. 44–58, Jan. 2001.

B. Schoenlinner; X. Wu; G.V. Eleftheriades; G.M. Rebeiz, "Spherical–Lens Antennas for Millimeter Wave Radars", European Microwave Week 2001 Proc., pp. 317–320, vol. 3, Sep., 2001.

B. Schoenlinner; G.M. Rebeiz, "Compact Multibeam Imageing Antenna for Automotive Radars", 2002 IEEE MTT–S Digest, pp. 1373–1376, Jun. 2002.

B. Schoenlinner; X. Wu; J.P. Ebling; G.V. Eleftheriades; G.M. Rebeiz, "Wide–Scan Spherical–Lens Antennas for Automotive Radars", IEEE Transactions on Microwave Theory and Techniques, vol. 50, No. 9, Sep. 2002.

* cited by examiner

MULTI-BEAM ANTENNA

CROSS REFERENCE TO RELATED APPLICATIONS

The instant application is a continuation-in-part of U.S. application Ser. No. 10/202,242, filed on Jul. 23, 2002, now U.S. Pat. No. 6,606,077, which is a continuation-in-part of U.S. application Ser. No. 09/716,736, filed on Nov. 20, 2000, now U.S. Pat. No. 6,424,319, which claims the benefit of U.S. Provisional Application Ser. No. 60/166,231 filed on Nov. 18, 1999, all of which are incorporated herein by reference.

DETAILED DESCRIPTION

Figure 1:
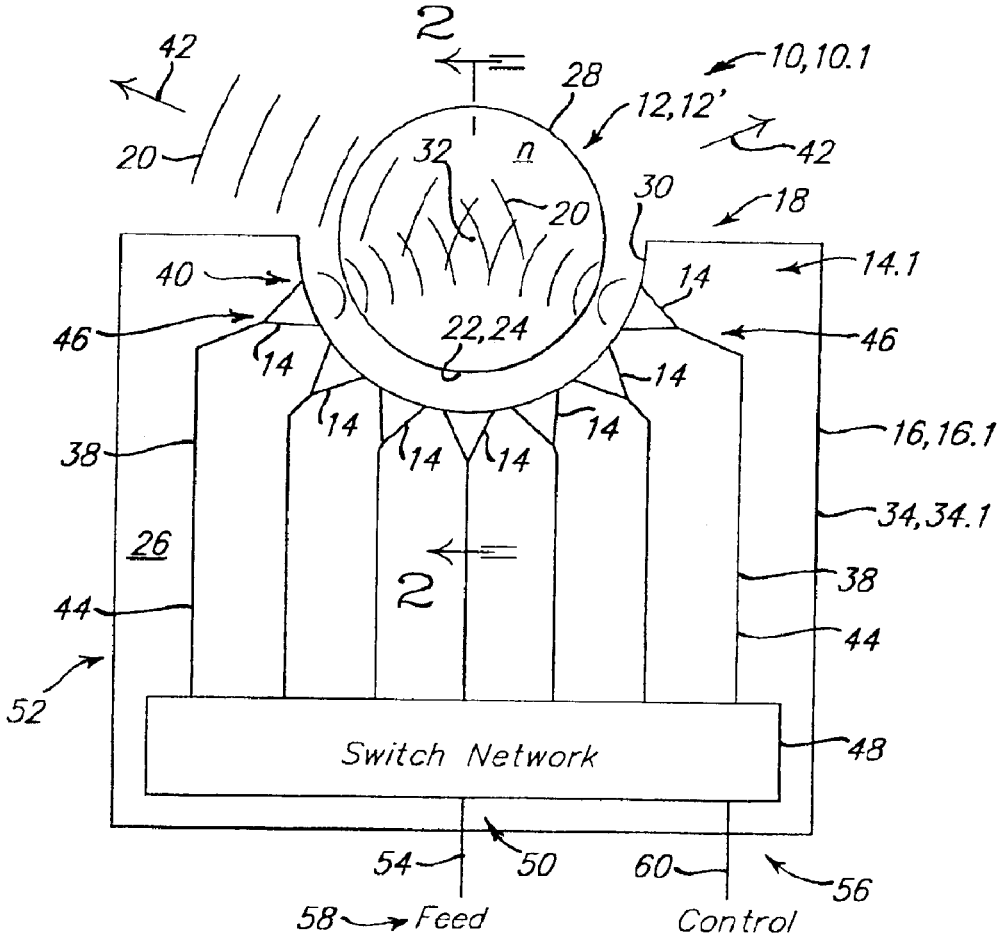
FIG. 1 illustrates a top view of a first embodiment of a multi-beam antenna comprising an electromagnetic lens.
Figure 2:
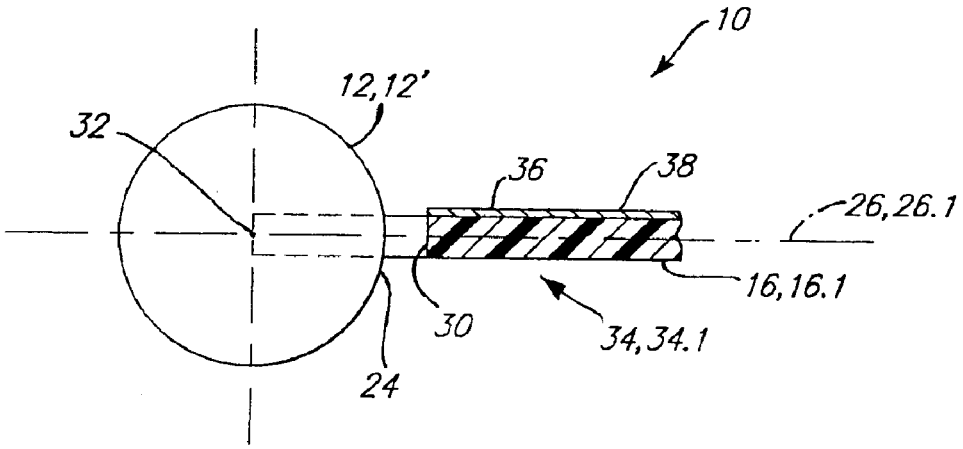
FIG. 2 illustrates a side cross-section of the embodiment of FIG. 1.

Referring to FIGS. 1 and 2, a multi-beam antenna 10, 10.1 comprises at least one electromagnetic lens 12 and a plurality of antenna feed elements 14 on a dielectric substrate 16 proximate to a first edge 18 thereof, wherein the plurality of antenna feed elements 14 are adapted to radiate a respective plurality of beams of electromagnetic energy 20 through the at least one electromagnetic lens 12.

Figure 3:
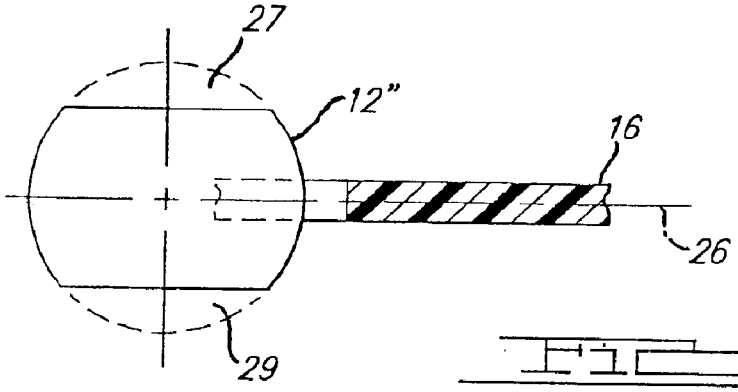
FIG. 3 illustrates a side cross-section of the embodiment of FIG. 1 incorporating a truncated electromagnetic lens.

The at least one electromagnetic lens 12 has a first side 22 having a first contour 24 at an intersection of the first side 22 with a reference surface 26, for example, a plane 26.1. The at least one electromagnetic lens 12 acts to diffract the electromagnetic wave from the respective antenna feed elements 14, wherein different antenna feed elements 14 at different locations and in different directions relative to the at least one electromagnetic lens 12 generate different associated beams of electromagnetic energy 20. The at least one electromagnetic lens 12 has a refractive index n different from free space, for example, a refractive index n greater than one (1). For example, the at least one electromagnetic lens 12 may be constructed of a material such as Rexolite™, TEFLON™, polyethylene, or polystyrene; or a plurality of different materials having different refractive indices, for example as in a Luneburg lens. In accordance with known principles of diffraction, the shape and size of the at least one electromagnetic lens 12, the refractive index n thereof, and the relative position of theantenna feed elements 14 to the electromagnetic lens 12 are adapted in accordance with the radiation patterns of the antenna feed elements 14 to provide a desired pattern of radiation of the respective beams of electromagnetic energy 20 exiting the second side 28 of the at least one electromagnetic lens 12. Whereas the at least one electromagnetic lens 12 is illustrated as a spherical lens 12' in FIGS. 1 and 2, the at least one electromagnetic lens 12 is not limited to any one particular design, and may, for example, comprise either a spherical lens, a Luneburg lens, a spherical shell lens, a hemispherical lens, an at least partially spherical lens, an at least partially spherical shell lens, a cylindrical lens, or a rotational lens. Moreover, one or more portions of the electromagnetic lens 12 may be truncated for improved packaging, without significantly impacting the performance of the associated multi-beam antenna 10, 10.1. For example, FIG. 3 illustrates an at least partially spherical electromagnetic lens 12" with opposing first 27 and second 29 portions removed therefrom.

Figure 4:
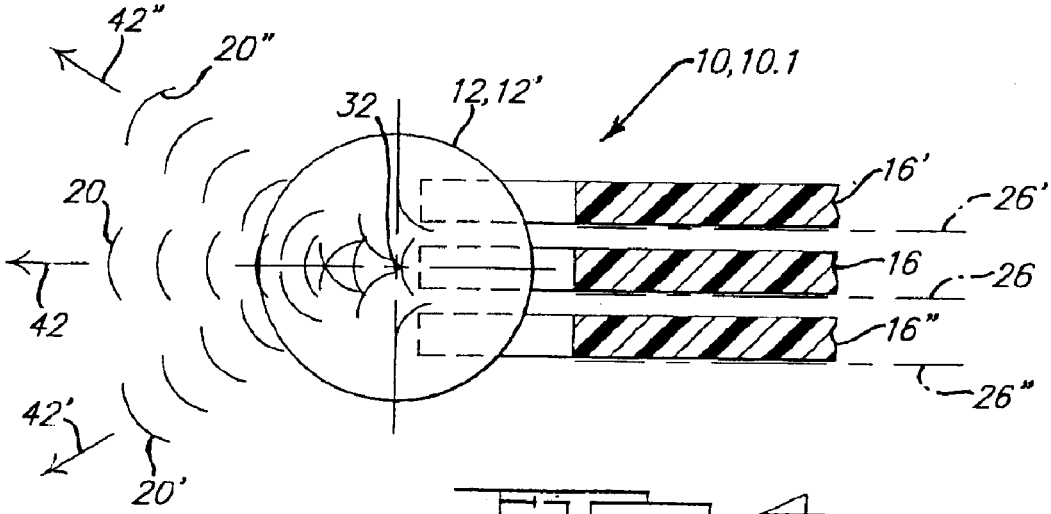
FIG. 4 illustrates a side cross-section of an embodiment illustrating various locations of a dielectric substrate, relative to an electromagnetic lens.

The first edge 18 of thedielectric substrate 16 comprises a second contour 30 that is proximate to the first contour 24. The first edge 18 of the dielectric substrate 16 is located on the reference surface 26, and is positioned proximate to the first side 22 of one of the at least one electromagnetic lens 12. The dielectric substrate 16 is located relative to the electromagnetic lens 12 so as to provide for the diffraction by the at least one electromagnetic lens 12 necessary to form thebeams of electromagnetic energy 20. For the example of a multi-beam antenna 10 comprising a planar dielectric substrate 16 located on reference surface 26 comprising a plane 26.1, in combination with an electromagnetic lens 12 having a center 32, for example, a spherical lens 12'; the plane 26.1 may be located substantially close to the center 32 of the electromagnetic lens 12 so as to provide for diffraction by at least a portion of the electromagnetic lens 12. Referring to FIG. 4, the dielectric substrate 16 may also be displaced relative to the center 32 of the electromagnetic lens 12, for example on one or the other side of thecenter 32 as illustrated by dielectric substrates 16' and 16", which are located on respective reference surfaces 26' and 26".

The dielectric substrate 16 is, for example, a material with low loss at an operating frequency, for example, DUROID™, a TEFLON™ containing material, a ceramic material, or a composite material such as an epoxy/fiberglass composite. Moreover, in one embodiment, the dielectric substrate 16 comprises a dielectric 16.1 of a circuit board 34, for example, a printed circuit board 34.1 comprising at least one conductive layer 36 adhered todielectric substrate 16, from which the antenna feed elements 14 and other associated circuit traces 38 are formed, for example, by subtractive technology, for example, chemical or ion etching, or stamping; or additive techniques, for example, deposition, bonding or lamination.

The plurality of antenna feed elements 14 are located on the dielectric substrate 16 along the second contour 30 of the first edge 18, wherein each antenna feed element 14 comprises a least one conductor 40 operatively connected to the dielectric substrate 16. For example, at least one of the antenna feed elements 14 comprises an end-fire antenna element 14.1 adapted to launch or receive electromagnetic waves in a direction 42 substantially towards or from the first side 22 of the at least one electromagnetic lens 12, wherein different end-fire antenna elements 14.1 are located at different locations along the second contour 30 so as to launch or receive respective electromagnetic waves in different directions 42. An end-fire antenna element 14.1 may, for example, comprise either a Yagi-Uda antenna, a coplanar horn antenna (also known as a tapered slot antenna), a Vivaldi antenna, a tapered dielectric rod, a slot antenna, a dipole antenna, or a helical antenna, each of which is capable of being formed on the dielectric substrate 16, for example, from a printed circuit board 34.1, for example,by subtractive technology, for example, chemical or ion etching, or stamping; or additive techniques, for example, deposition, bonding or lamination. Moreover, the antenna feed elements 14 may be used for transmitting, receiving or both.

Referring to FIG. 4, the direction 42 of the one or more beams of electromagnetic energy 20 through the electromagnetic lens 12, 12' is responsive to the relative location of the dielectric substrate 16, 16' or 16" and the associated reference surface, 26, 26' or 26" relative to the center 32 of the electromagnetic lens 12. For example, with the dielectric substrate 16 substantially aligned with the center 32, the directions 42 of the one or more beams of electromagnetic energy 20 are nominally aligned with the reference surface 26. Alternately, with the dielectric substrate 16' above the center 32 of the electromagnetic lens 12, 12', the resulting one or more beams of electromagnetic energy 20' propagate in directions 42' below the center 32. Similarly, with thedielectric substrate 16" below the center 32 of the electromagnetic lens 12, 12', the resulting one or more beams of electromagnetic energy 20" propagate in directions 42" above the center 32.

The multi-beam antenna 10 may further comprise at least one transmission line 44 on the dielectric substrate 16 operatively connected to a feed port 46 of one of the plurality of antenna feed elements 14 for feeding a signal to the associated antenna feed element 14. For example, the at least one transmission line 44 may comprise either a stripline, a microstrip line, an inverted microstrip line, a slotline, an image line, an insulated image line, a tapped image line, a coplanar stripline, or a coplanar waveguide line formed on thedielectric substrate 16, for example, from a printed circuit board 34.1, for example, by subtractive technology, for example, chemical or ion etching, or stamping; or additive techniques, for example, deposition, bonding or lamination.

The multi-beam antenna 10 may further comprise a switching network 48 having at least one input 50 and a plurality of outputs 52, wherein the at least one input 50 is operatively connected—for example, via at least one above described transmission line 44—to a corporate antenna feed port 54, and each output 52 of the plurality of outputs 52 is connected—for example, via at least one above described transmission line 44—to a respectivefeed port 46 of a different antenna feed element 14 of the plurality of antenna feed elements 14. The switching network 48 further comprises at least one control port 56 for controlling which outputs 52 are connected to the at least one input 50 at a given time. The switching network 48 may, for example, comprise either a plurality of micro-mechanical switches, PIN diode switches, transistor switches, or a combination thereof, and may, for example, be operatively connected to the dielectric substrate 16, for example, by surface mount to an associated conductive layer 36 of a printed circuit board 34.1.

In operation, a feed signal 58 applied to the corporate antenna feed port 54 is either blocked—for example, by an open circuit, by reflection or by absorption, —or switched to the associated feed port 46 of one or more antenna feed elements 14, via one or more associated transmission lines 44, by the switching network 48, responsive to a control signal 60 applied to the control port 56. It should be understood that the feed signal 58 may either comprise a single signal common to each antenna feed element 14, or a plurality of signals associated with different antenna feed elements 14. Each antenna feed element 14 to which the feed signal 58 is applied launches an associated electromagnetic wave into the first side 22 of the associated electromagnetic lens 12, which is diffracted thereby to form an associated beam of electromagnetic energy 20. The associated beams of electromagnetic energy 20 launched by different antenna feed elements 14 propagate in different associated directions 42. The various beams of electromagnetic energy 20 may be generated individually at different times so as to provide for a scanned beam of electromagnetic energy 20. Alternately, two or more beams of electromagnetic energy 20 may be generated simultaneously. Moreover, different antenna feed elements 14 may be driven by different frequencies that, for example, are either directly switched to the respective antenna feed elements 14, or switched via an associated switching network 48 having a plurality of inputs 50, at least some of which are each connected to different feed signals 58.

Figure 5:
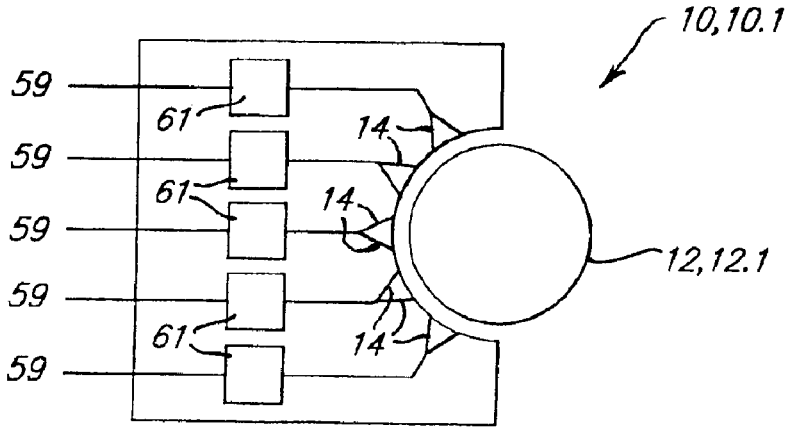
FIG. 5 illustrates an embodiment wherein each antenna feed element is operatively coupled to a separate signal.

Referring to FIG. 5, the multi-beam antenna 10,10.1 may be adapted so that the respective signals are associated with the respectiveantenna feed elements 14 in a one-to-one relationship, thereby precluding the need for an associated switching network 48. For example, each antenna feed element 14 can be operatively connected to an associated signal 59 through an associated processing element 61. As one example, with the multi-beam antenna 10,10.1 configured as an imaging array, the respective antenna feed elements 14 are used to receive electromagnetic energy, and the respective processing elements 61 comprise detectors. As another example, with the multi-beam antenna 10,10.1 configured as a communication antenna, the respective antenna feed elements 14 are used to both transmit and receive electromagnetic energy, and the respective processing elements 61 comprise transmit/receive modules or transceivers.

Figure 6:
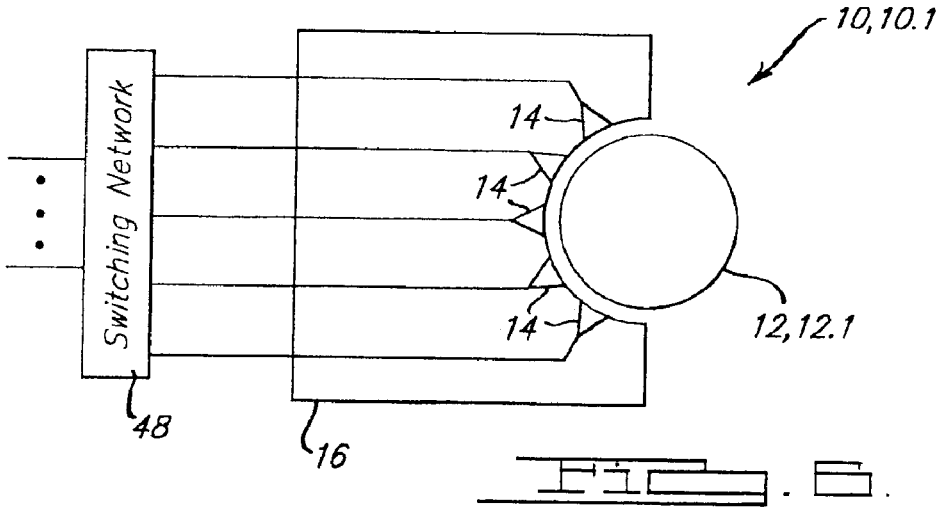
FIG. 6 illustrates an embodiment wherein the switching network is separately located from the dielectric substrate.

Referring to FIG. 6, the switching network 48, if used, need not be collocated on a common dielectric substrate 16, but can be separately located, as, for example, may be useful for low frequency applications, for example, 1–20 GHz.

Figure 7:
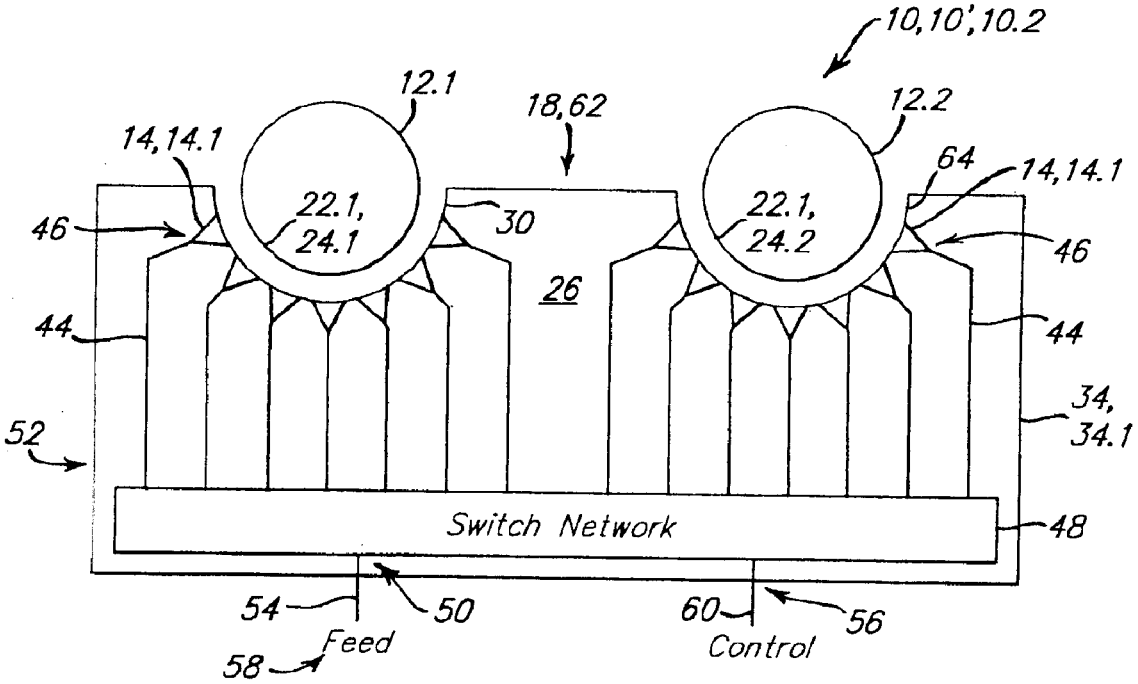
FIG. 7 illustrates a top view of a second embodiment of a multi-beam antenna, comprising a plurality of electromagnetic lenses located proximate to one edge of a dielectric substrate.
Figure 8:
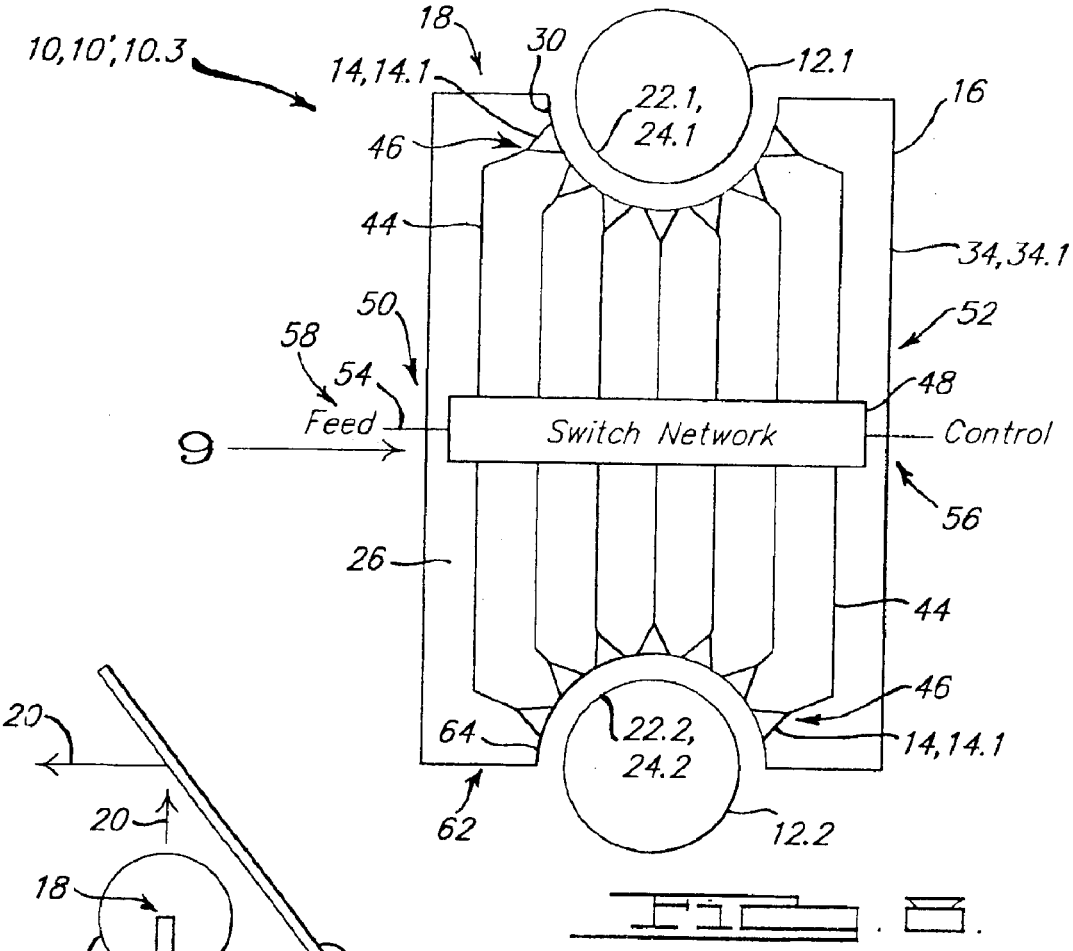
FIG. 8 illustrates a top view of a third embodiment of a multi-beam antenna, comprising a plurality of electromagnetic lenses located proximate to opposite edges of a dielectric substrate.
Figure 9:
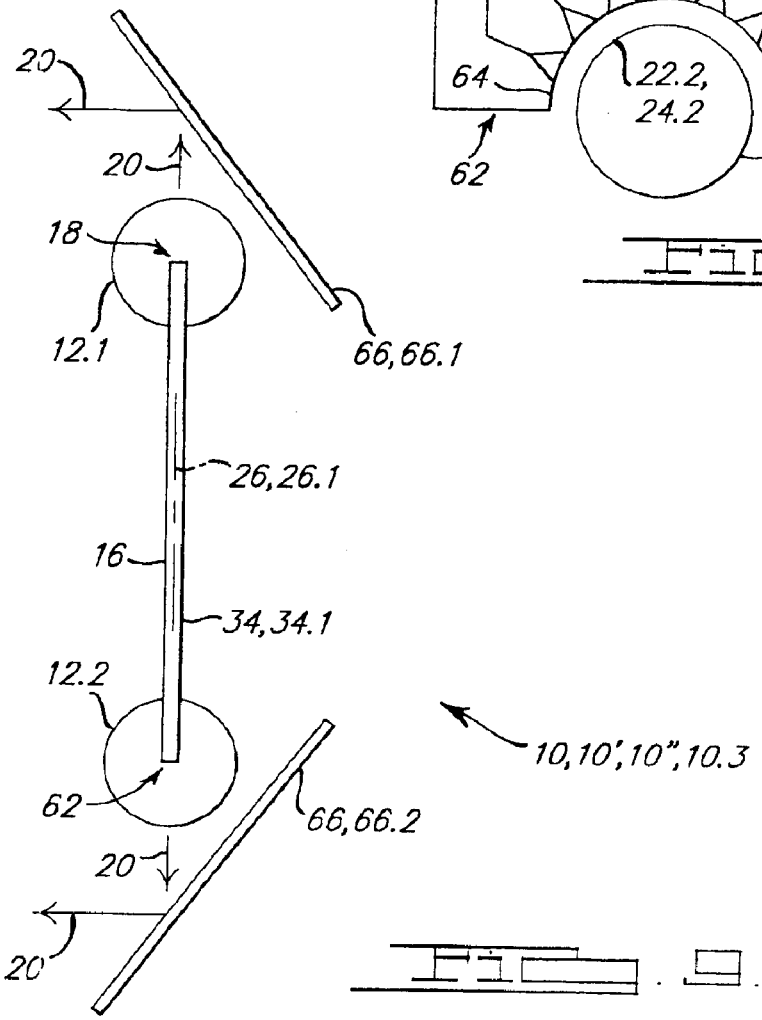
FIG. 9 illustrates a side view of the third embodiment illustrated in FIG. 8, further comprising a plurality of reflectors.

Referring to FIGS. 7, 8 and 9, in accordance with a second aspect, a multi-beam antenna 10' comprises at least a first 12.1 and a second 12.2 electromagnetic lens, each having a first side 22.1, 22.2 with a corresponding first contour 24.1, 24.2 at an intersection of the respective first side 22.1, 22.2 with the reference surface 26. The dielectric substrate 16 comprises at least a second edge 62 comprising a third contour 64, wherein the second contour 30 is proximate to the first contour 24.1 of the first electromagnetic lens 12.1 and the third contour 64 is proximate to the first contour 24.2 of the second electromagnetic lens 12.2.

Referring to FIG. 7, in accordance with a second embodiment of the multi-beam antenna 10.2, the second edge 62 is the same as the first edge 18 and the second 30 and third 64 contours are displaced from one another along the first edge 18 of the dielectric substrate 16.

Referring to FIG. 8, in accordance with a third embodiment of the multi-beam antenna 10.3, the second edge 62 is different from the first edge 18, and more particularly is opposite to the first edge 18 of the dielectric substrate 16.

Referring to FIG. 9, in accordance with a third aspect, a multi-beam antenna 10" comprises at least one reflector 66, wherein the reference surface 26 intersects the at least one reflector 66 and one of the at least one electromagnetic lens 12 is located between the dielectric substrate 16 and the reflector 66. The at least one reflector 66 is adapted to reflect electromagnetic energy propagated through the at least one electromagnetic lens 12 after being generated by at least one of the plurality of antenna feed elements 14. A third embodiment of the multi-beam antenna 10 comprises at leastfirst 66.1 andsecond 66.2 reflectors wherein the first electromagnetic lens 12.1 is located between the dielectric substrate 16 and the first reflector 66.1, the second electromagnetic lens 12.2 is located between the dielectric substrate 16 and the second reflector 66.2, the first reflector 66.1 is adapted to reflect electromagnetic energy propagated through the first electromagnetic lens 12.1 after being generated by at least one, of the plurality of antenna feed elements 14 on the second contour 30, and the second reflector 66.2 is adapted to reflect electromagnetic energy propagated through the second electromagnetic lens 12.2 after being generated by at least one of the plurality of antenna feed elements 14 on the third contour 64. For example, the first 66.1 and second 66.2 reflectors may be oriented to direct the beams of electromagnetic energy 20 from each side in a common nominal direction, as illustrated in FIG. 9. Referring to FIG. 9, the multi-beam antenna 10" as illustrated would provide for scanning in a direction normal to the plane of the illustration. If the dielectric substrate 16 were rotated by 90 degrees with respect to the reflectors 66.1, 66.2, about an axis connecting the respective electromagnetic lenses 12.1, 12.1, then the multi-beam antenna 10" would provide for scanning in a direction parallel to the plane of the illustration.

Figure 10:
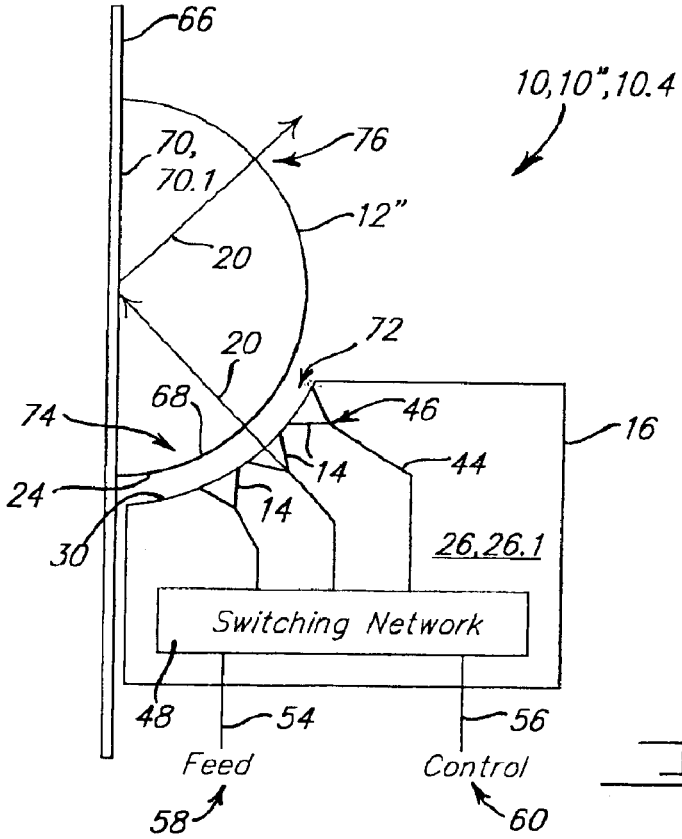
FIG. 10 illustrates a fourth embodiment of a multi-beam antenna, comprising an electromagnetic lens and a reflector.

Referring to FIG. 10, in accordance with the third aspect and a fourth embodiment, a multi-beam antenna 10", 10.4 comprises an at least partially spherical electromagnetic lens 12'", for example, a hemispherical electromagnetic lens, having a curved surface 68 and a boundary 70, for example a flat boundary 70.1. The multi-beam antenna 10", 10.4 further comprises a reflector 66 proximate to the boundary 70, and a plurality of antenna feed elements 14 on a dielectric substrate 16 proximate to a contoured edge 72 thereof, wherein each of the antenna feed elements 14 is adapted to radiate a respective plurality of beams of electromagnetic energy 20 into a first sector 74 of theelectromagnetic lens 12'". The electromagnetic lens 12'" has a first contour 24 at an intersection of the first sector 74 with a reference surface 26, for example, a plane 26.1. The contoured edge 72 has asecond contour 30 located on the reference surface 26 that is proximate to the first contour 24 of the first sector 74. The multi-beam antenna 10", 10.4 further comprises a switching network 48 and a plurality of transmission lines 44 operatively connected to the antenna feed elements 14 as described hereinabove for the other embodiments.

In operation, at least one feed signal 58 applied to a corporate antenna feed port 54 is either blocked, or switched to the associated feed port 46 of one or more antenna feed elements 14, via one or more associated transmission lines 44, by the switching network 48 responsive to a control signal 60 applied to a control port 56 of the switching network 48. Each antenna feed element 14 to which the feed signal 58 is applied launches an associated electromagnetic wave into the first sector 74 of the associated electromagnetic lens 12'". The electromagnetic wave propagates through—and is diffracted by—the curved surface 68, and is then reflected by the reflector 66 proximate to the boundary 70, whereafter the reflected electromagnetic wave propagates through the electromagnetic lens 12'" and exits—and is diffracted by—a second sector 76 as an associated beam of electromagnetic energy 20. With the reflector 66 substantially normal to the reference surface 26—as illustrated in FIG. 10—the different beams of electromagnetic energy 20 are directed by the associated antenna feed elements 14 in different directions that are nominally substantially parallel to the reference surface 26.

Figure 11:
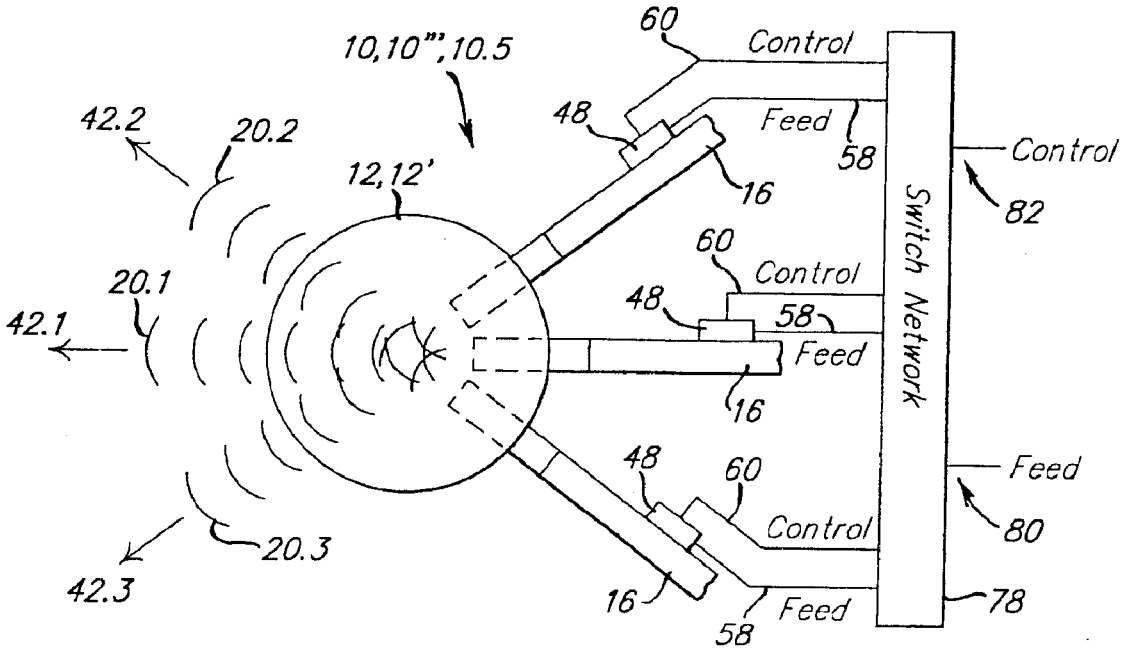
FIG. 11 illustrates a fifth embodiment of a multi-beam antenna.

Referring to FIG. 11, in accordance with a fourth aspect and a fifth embodiment, a multi-beam antenna 10'", 10.5 comprises an electromagnetic lens 12 and plurality of dielectric substrates 16, each comprising a set of antenna feed elements 14 and operating in accordance with the description hereinabove. Each set of antenna feed elements 14 generates (or is capable of generating) an associated set of beams of electromagnetic energy 20.1,20.2 and 20.3, each having associated directions 42.1, 42.2 and 42.3, responsive to the associated feed 58 and control 60 signals. The associated feed 58 and control 60 signals are either directly applied to the associated switch network 48 of the respective sets of antenna feed elements 14, or are applied thereto through a second switch network 78 having associated feed 80 and control 82 ports, each comprising at least one associated signal. Accordingly, the multi-beam antenna 10''', 10.4 provides for transmitting or receiving one or more beams of electromagnetic energy over a three-dimensional space.

The multi-beam antenna 10 provides for a relatively wide field-of-view, and is suitable for a variety of applications, including but not limited to automotive radar, point-to-point communications systems and point-to-multi-point communication systems, over a wide range of frequencies for which the antenna feed elements 14 may be designed to radiate, for example, 1 to 200 GHz. Moreover, the multi-beam antenna 10 may be configured for either mono-static or bi-static operation.

Figure 12:
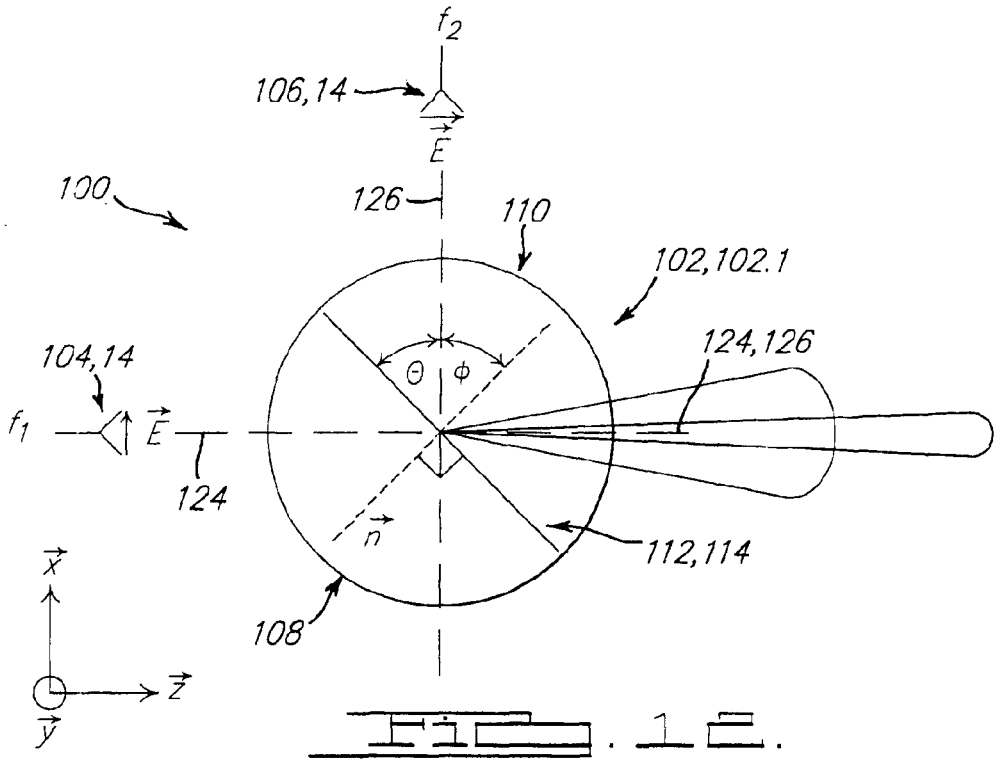
FIG. 12 illustrates a sixth embodiment of a multi-beam antenna incorporating a first embodiment of a selective element.

Referring to FIG. 12, in accordance with a fifth aspect and a sixth embodiment, a multi-beam antenna 100 comprises an electromagnetic lens 102, at least one first antenna feed element 104, 14, and at least one second antenna feed element 106, 14. The electromagnetic lens 102 comprises first 108 and second 110 portions, wherein the at least one first antenna feed element 104, 14 is located proximate to the first portion 108 of theelectromagnetic lens 102, and the at least one second antenna feed element 106, 14 is located proximate to the second portion 110 of the electromagnetic lens 102, so that the respective feed elements 104 106, 14 cooperate with the respective portions 108, 110 of the electromagnetic lens 102 to which they are proximate. For example, the electromagnetic lens 102 may comprise either a spherical lens 102.1, a Luneburg lens, a spherical shell lens, a hemispherical lens, an at least partially spherical lens, an at least partially spherical shell lens, a cylindrical lens, or a rotational lens divided into first 108 and second 110 portions.

The multi-beam antenna 100 further comprises a selective element 112 located between the first 108 andsecond 110 portions of the electromagnetic lens 102, wherein the selective element 112 has a transmissivity and a reflectivity that are responsive to an electromagnetic wave property, for example either frequency or polarization. The transmissivity of the selective element 112 is adapted so that a first electromagnetic wave, in cooperation with thefirst antenna feed element 104, 14 and having a first value of the electromagnetic wave property, is substantially transmitted through the selective element 112 so as to propagate in both the first 108 and second 110 portions of the electromagnetic lens 102. The reflectivity of the selective element 112 is adapted so that a second electromagnetic wave, in cooperation with the second antenna feed element 106, 14 and having a second value of the electromagnetic wave property, is substantially reflected by the selective element 112. In the sixth embodiment illustrated in FIG. 12, the selective element 112 is adapted with a frequency selective surface 114 essentially a diplexer—so that the transmissivity and reflectivity thereof are responsive to the frequency of an electromagnetic wave impinging thereon. Accordingly, a first electromagnetic wave having a first carrier frequency $f_1$ and cooperating with the first antenna feed element 104, 14 is transmitted, with relatively little attenuation, through the selective element 112, and a second electromagnetic wave having a second carrier frequency $f_2$ different from the first carrier frequency $f_1$—and cooperating with the second antenna feed element 106, 14 is reflected, with relatively little attenuation, by the selective element 112.

Figure 13:
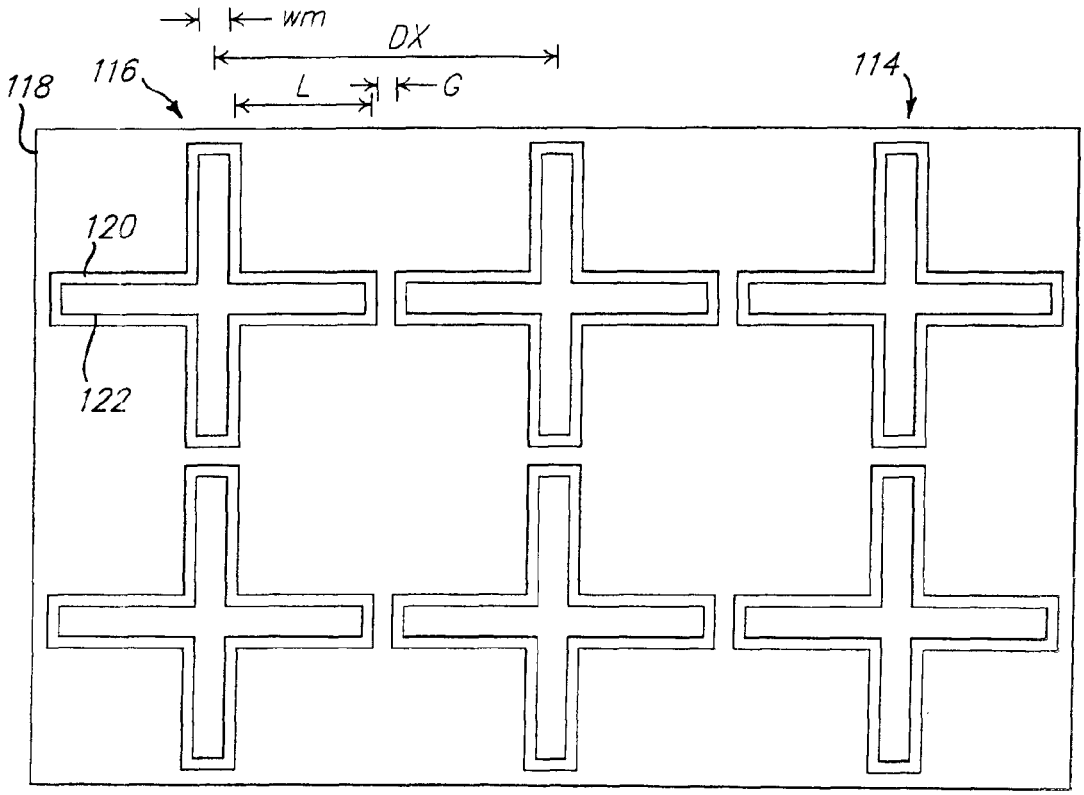
FIG. 13 illustrates an example of a frequency selective surface in accordance with the first embodiment of the selective element.
Figure 14:
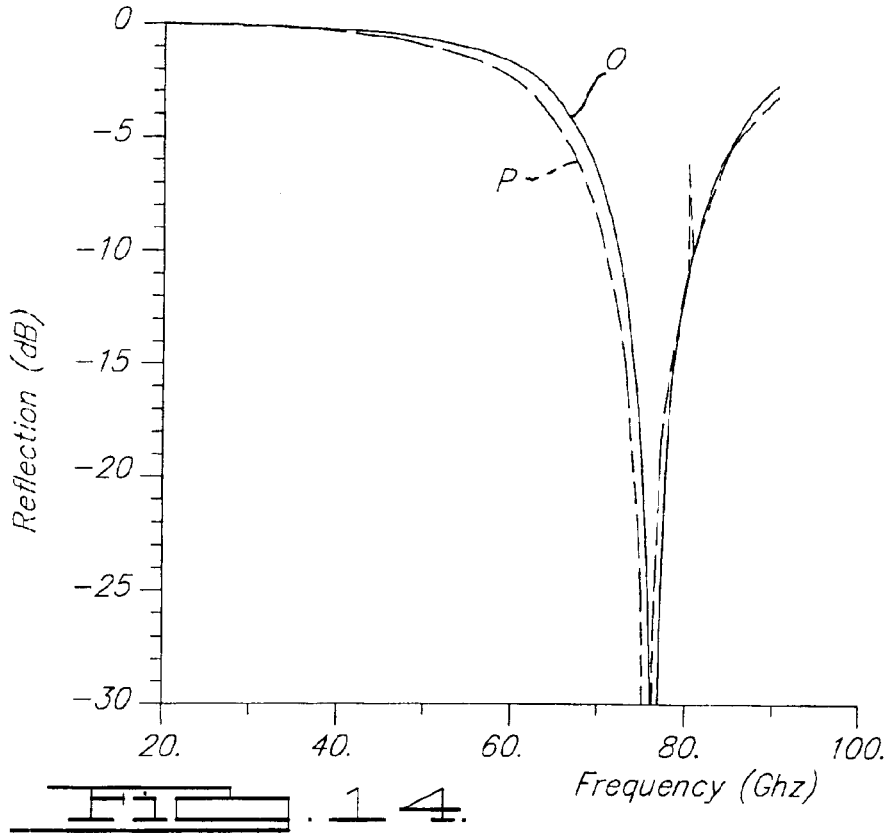
FIG. 14 illustrates the reflectivity as a function of frequency of the frequency selective surface illustrated in FIG. 13.
Figure 15:
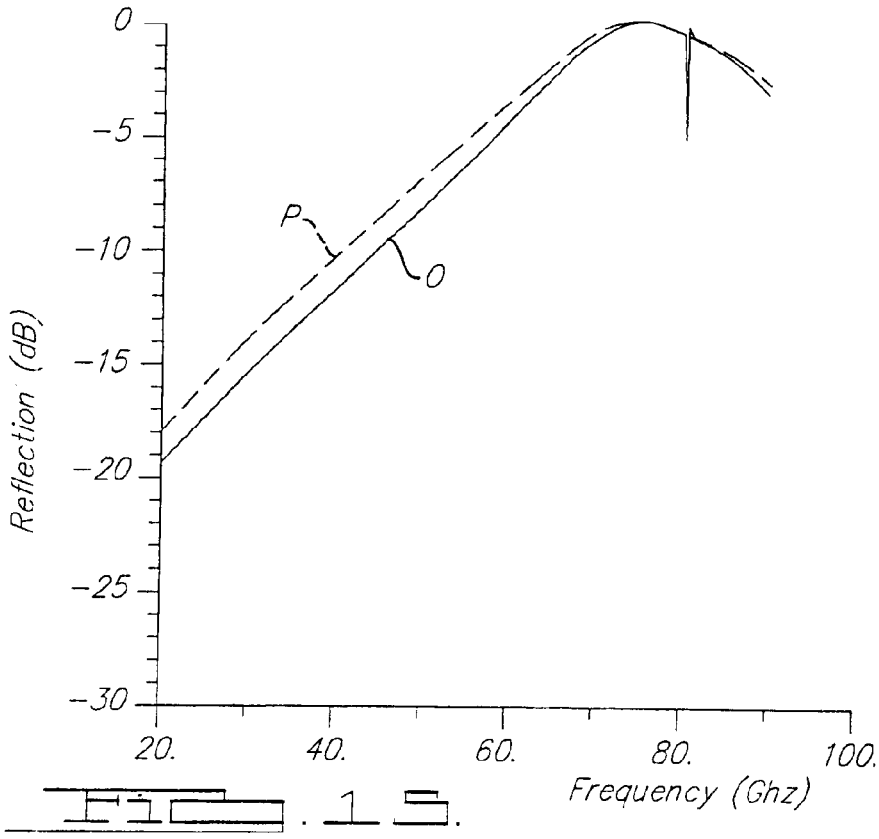
FIG. 15 illustrates the transmissivity as a function of frequency of the frequency selective surface illustrated in FIG. 13.

The frequency selective surface 114 can be constructed by forming a periodic structure of conductive elements, e.g. by etching a conductive sheet on a substrate material having a relatively low dielectric constant, e.g. DUROID™ or TEFLON™. For example, referring to FIG. 13, the frequency selective surface 114 is formed by a field of what are known as Jerusalem Crosses 116, which provides for reflectivity and transmissivity characteristics illustrated in FIGS. 14 and 15 respectively, wherein the frequency selective surface 114 is sized so as to substantially transmit a first electromagnetic wave having an associated first carrier frequency $f_1$ of 77 GHz, and to substantially reflect a second electromagnetic wave having an associated first carrier frequency $f_1$ of 24 GHz. In FIGS. 14 and 15, "O" and "P" represent orthogonal and parallel polarizations respectively. Each Jerusalem Cross 116 is separated from a surrounding conductive surface 118 by a slot 120 that is etched thereinto, wherein the slot 120 has an associated slot width ws. Each Jerusalem Cross 116 comprises fourlegs 122 of leg length L and leg width wm extending from a central square hub and forming a cross. Adjacent Jerusalem Crosses 116 are separated from one another by the associatedslots 120, and by conductive gaps G, so as to form a periodic structure with a periodicity DX in both associated directions of the Jerusalem Crosses 116. The exemplary embodiment illustrated in FIG. 13 having a pass frequency of 77 GHz is characterized as follows: slot width ws=80 microns, leg width wm=200 microns, gap G=150 microns, leg length L=500 microns, and periodicity DX=1510 microns (in both orthogonal directions), where DX=wm+2(L+ws)+G. Generally the frequency selective surface 114 comprises a periodic structure of conductive elements, for example, located on a dielectric substrate, for example, substantially located on a plane. The conductive elements need not necessarily be located on a substrate. For example, the frequency selective surface 114 could be constructed from a conductive material with periodic holes or openings of appropriate size, shape and spacing. Alternately, the frequency selective surface 114 may comprise a conductive layer on one or both inner surfaces of the respective first 108 and second 110 portions of the electromagnetic lens 102. Whereas FIG. 13 illustrates a Jerusalem Cross 116 as a kernel element of the associate periodic structure of the frequency selective surface 114, other shapes for the kernel element are also possible, for example circular, doughnut, rectangular, square, or potent cross, for example, as illustrated in the following technical papers that are incorporated herein by reference: "Antenna Design on Periodic and Aperiodic Structures" by Zhifang Li, John L. Volakis and Panos Y. Papalambros accessible at Internet address http://ode.engin.umich.edu/papers/APS2000.pdf; and "Plane Wave Diffraction by Two-Dimensional Gratings of Inductive and Capacitive Coupling Elements" by Yu. N. Kazantsev, V. P. Mal'tsev, E. S. Sokolovskaya, and A. D. Shatrov in "Journal of Radioelectronics" N. 9, 2000 accessible at Internet address http://jre.cplire.ru/jre/sep00/4/text.html.

Experiments have also shown that in a system with first $f_1$ and second $f_2$ carrier frequencies selected from 24 GHz and 77 GHz, an electromagnetic wave having a 24 GHz carrier frequency generates harmonic modes when passed through the frequency selective surface 114 illustrated in FIG. 13. Accordingly, a first carrier frequency $f_1$ (of the transmitted electromagnetic wave) greater than the second carrier frequency $f_2$ (of the reflected electromagnetic wave) would beneficially provide for reduced harmonic modes. However, it is possible to have a wider field of view in the transmitted electromagnetic wave than in the reflected electromagnetic wave. More particularly, the beam patterns from a reflected feed source are, for example, only well behaved over a range of approximately +/−20°, which would limit the field of view to approximately 40°. In some applications, e.g. automotive radar, it is beneficial for the lower frequency electromagnetic wave to have a wider field of view. Accordingly, it can be beneficial for the first carrier frequency $f_1$ (of the transmitted electromagnetic wave) to have the lower frequency (e.g. 24 GHz), which can be facilitated with a multiple layer frequency selective surface 114.

The frequency selective surface 114 may comprise either a single layer or a multiple layer. A multiple layer frequency selective surface 114 may provide for controlling the harmonic modes, for example, as generated by the lower frequency radiation, thereby improving the transmission of the lower frequency radiation through the frequency selective surface 114, so as to provide for a wider field of view of the associated radiation pattern extending from the electromagnetic lens 102.

The at least one first antenna feed element 104, 14 and at least one second antenna feed element 106, 14 comprises respective end-fire antenna elements adapted to launch electromagnetic waves in a direction substantially towards the first 108 and second 110 portions of the at least one electromagnetic lens 102 respectively. For example, each of the respective end-fire antenna elements may be either a Yagi-Uda antenna, a coplanar horn antenna, a Vivaldi antenna, a tapered dielectric rod, a slot antenna, a dipole antenna, or a helical antenna.

The at least one first antenna feed element 104, 14 has a corresponding at least onefirst axis of principal gain 124, which is directed through both the first 108 and second 110 portions of the electromagnetic lens 102, and the at least one second antenna feed element 106, 14 has a corresponding at least one second axis of principal gain 126, which is directed through at least the second portion 110 of the electromagnetic lens 102, and the at least one second antenna feed element 106, 14 and the selective element 112 are adapted so that a reflection at least one second axis of principal gain 126 from the selective element 112 is generally aligned with at least one first axis of principal gain 124 in the second portion 110 of the electromagnetic lens 102.

Figure 16B:
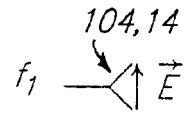
FIGS. 16*a* and 16*b* illustrate a seventh embodiment of a multi-beam antenna incorporating a second embodiment of the selective element.
Figure 16A:
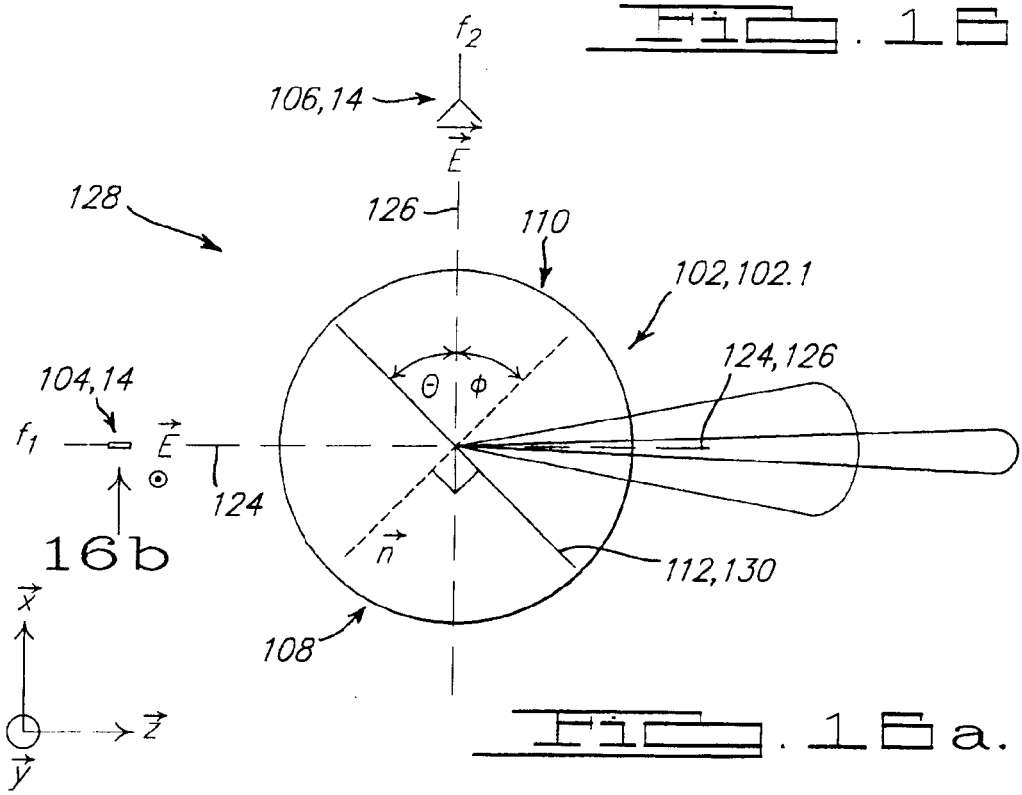

Referring to FIG. 16*a*, in accordance with a seventh embodiment, a multi-beam antenna 128 incorporates a polarization selective element 130 for which the reflectivity or transmissivity thereof is responsive to the polarization of the electromagnetic wave impinging thereon. More particularly, one of two orthogonal polarizations is substantially transmitted by the polarization selective element 130, and the other of two orthogonal polarizations is substantially reflected by the polarization selective element 130. For example, the first electromagnetic wave associated with the first antenna feed element 104, 14 is polarized in the y direction—e.g. by rotating the first antenna feed element 104, 14 relative to the second antenna feed element 106, 14, or by an associated antenna feed element that is orthogonally polarized with respect to the associated underlying substrate—so as to be substantially transmitted (i.e. with relatively small attenuation) through the polarization selective element 130; and the second electromagnetic wave associated with the second antenna feed element 106, 14 is polarized in the z direction so as to be substantially reflected by the polarization selective element 130. For example, the polarization selective element 130 can be what is known as a polarized reflector, wherein the second antenna feed element 106, 14 is adapted to have the same polarization as the polarized reflector. For example, a polarized reflective surface can be fabricated by etching properly dimensioned parallel metal lines at an associated proper spacing on a relatively low dielectric substrate.

Figure 17:
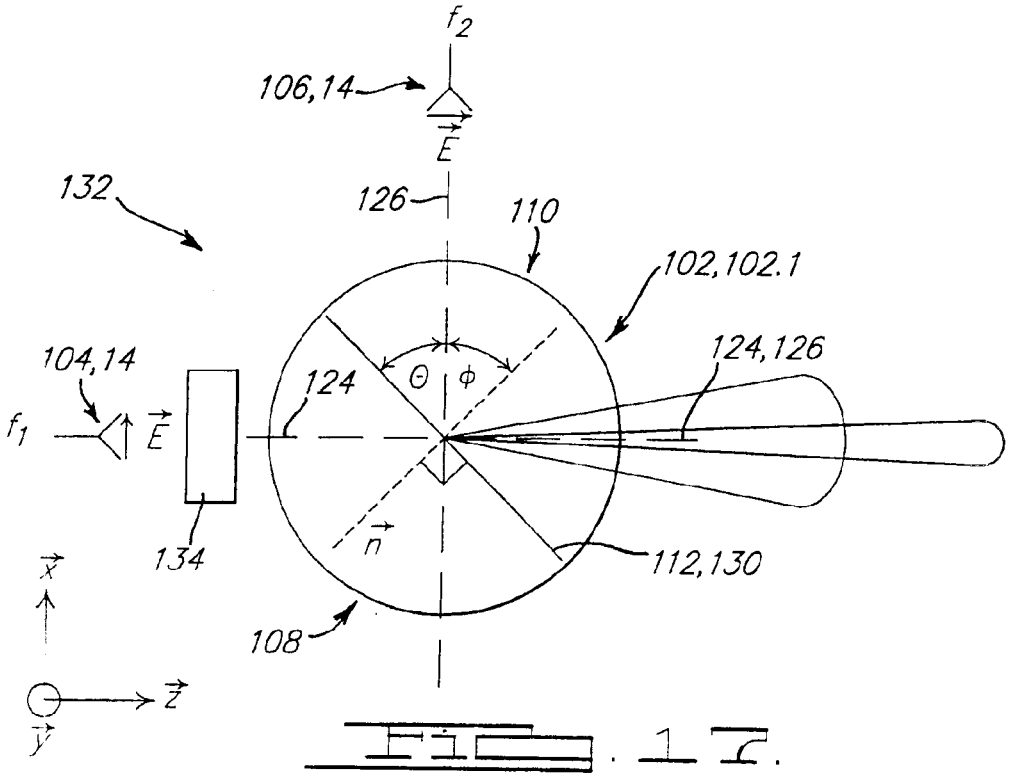
FIG. 17 illustrates an eighth embodiment of a multi-beam antenna incorporating the second embodiment of the selective element, further incorporating a polarization rotator.

Referring to FIG. 17, in accordance with an eighth embodiment of a multi-beam antenna 132 incorporating a polarization selective element 130, a polarization rotator 134 is incorporated between the first antenna feed element 104, 14 and the first portion 108 of the electromagnetic lens 102, for example, so that the first 104 and second 106 antenna feed elements 14 can be constructed on a common substrate. Alternately, instead of incorporating a separate polarization rotator 134, the first portion 108 of the electromagnetic lens 102 may be adapted to incorporate an associated polarization rotator.

It should be understood that the polarization selective element 130 and associatedsecond antenna feed element 106, 14, or polarization rotator 134 proximate thereto, may alternately be adapted as was the first antenna feed element 104, 14, or polarization rotator 134 proximate thereto, in the embodiments of FIGS. 16*a* and 17. The resulting beam patterns for a polarization selective element 130 would be similar to those for a frequency selective surface 114.

Figure 18:
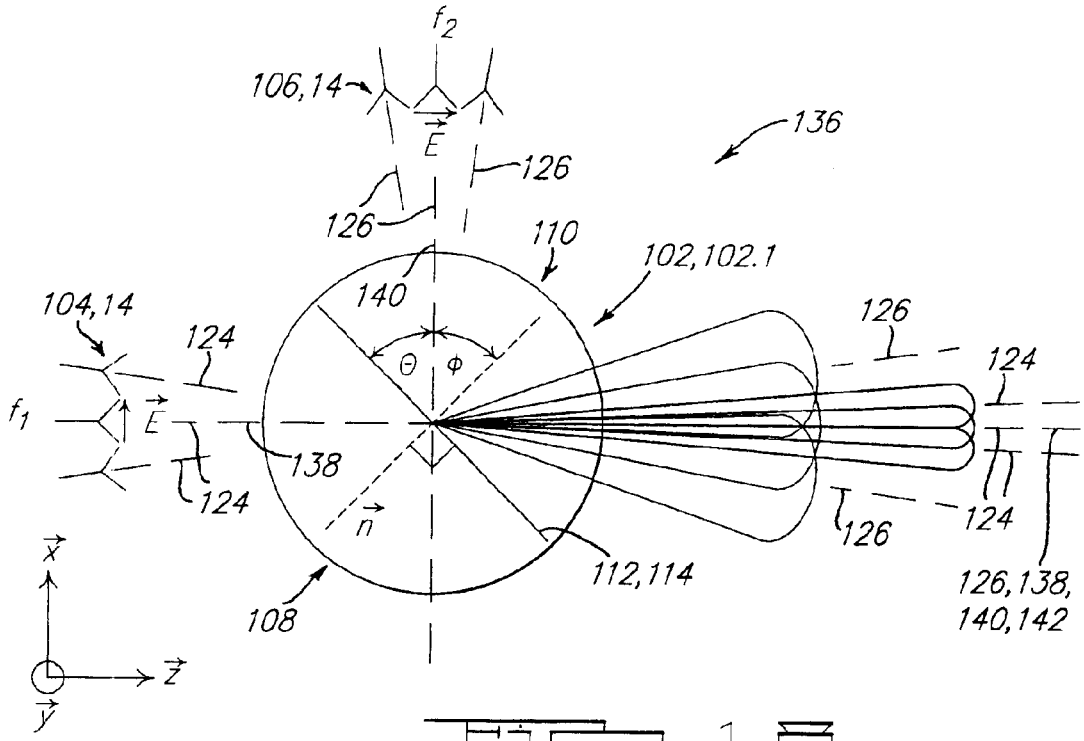
FIG. 18 illustrates a ninth embodiment of a multi-beam antenna incorporating the first embodiment of the selective element.

Referring to FIG. 18, in accordance with a ninth embodiment, a multi-beam antenna 136 incorporates a plurality of first antenna feed elements 104, 14 and a plurality of second antenna feed elements 106, 14 so as to provide for multi-beam coverage by each. The plurality of first antenna feed elements 104, 14 has an associated first median axis of principal gain 138, and the plurality ofsecond antenna feed elements 106, 14 has an associated second median axis of principal gain 140.

For example, by orienting the frequency selective surface 114 at an angle $\theta=45°$ to the intended median direction of propagation, and the plurality ofsecond antenna feed elements 106, 14 at an angle $\theta+\phi=90°$, the associated second electromagnetic wave(s) can be propagated in the intended direction. By orienting the plurality of first antenna feed elements 104, 14 on the median axis of intended propagation, the associated first electromagnetic wave(s) will propagate through the selective element 112 along the intended direction of propagation. The particular angle $\theta$ is not considered to be limiting. Moreover, a polarization selective element 130 can generally operate over a relatively wide range of angles.

The pluralities of first 104 and second 106 antenna feed elements 106, 14 may be constructed as described hereinabove for the embodiments illustrated in FIGS. 1–5, wherein the direction for at least one the first end-fire antenna elements is different for the direction of at least another the first end-fire antenna element, and the direction for at least one the second end-fire antenna element is different for the direction of at least another the second end-fire antenna element.

For example, the at least one first antenna feed element 104, 14 comprises a plurality of first antenna feed elements 104, 14 arranged substantially on a first plane, and the at least one second antenna feed element 106, 14 comprises a plurality of second antenna feed elements 106, 14 arranged substantially on a second plane. The first and second planes are at least substantially parallel to one another in one embodiment, and may be at least substantially coplanar so as to provide for mounting all of the antenna feed elements 104, 106,14 on a common substrate.

The at least one first antenna feed element 104, 14 has a corresponding first median axis of principal gain 138, which is directed through both the first 108 and second 110 portion 110 of the electromagnetic lens 102. The at least one second antenna feed element 106, 14 has a corresponding second median axis of principal gain 140, which is directed through at least the second portion 110 of the electromagnetic lens 102, and the at least one second antenna feed element 106, 14 and the selective element 112 are adapted so that a reflection 142 of the second median axis of principal gain 140 from the selective element 112 is generally aligned with the first median axis of principal gain 138 in the second portion 110 of the electromagnetic lens 102.

Figure 19:
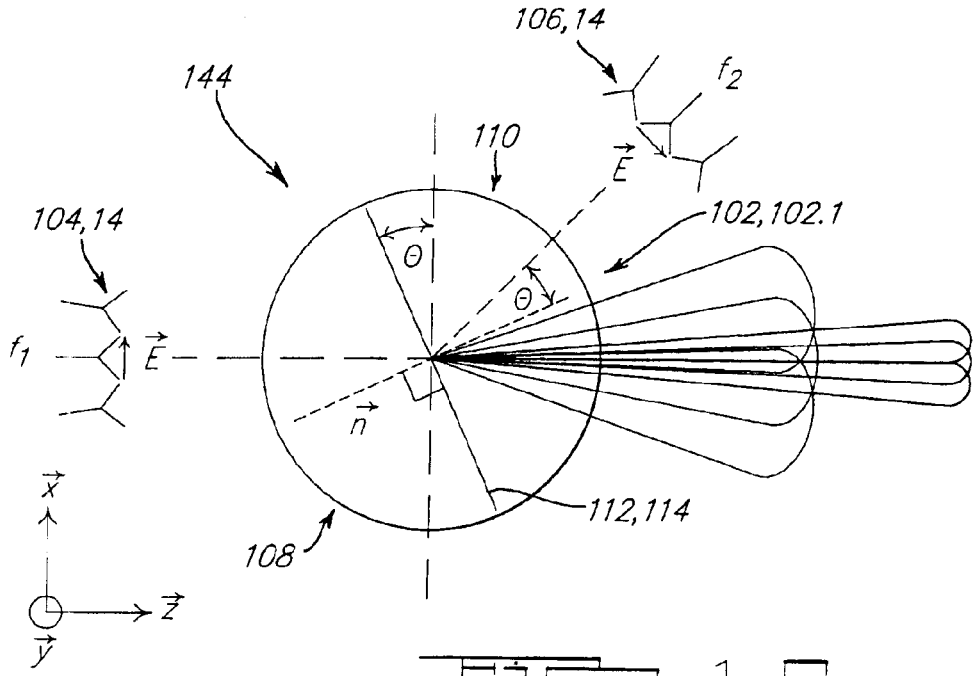
FIG. 19 illustrates a tenth embodiment of a multi-beam antenna incorporating the first embodiment of the selective element.
Figure 20A:
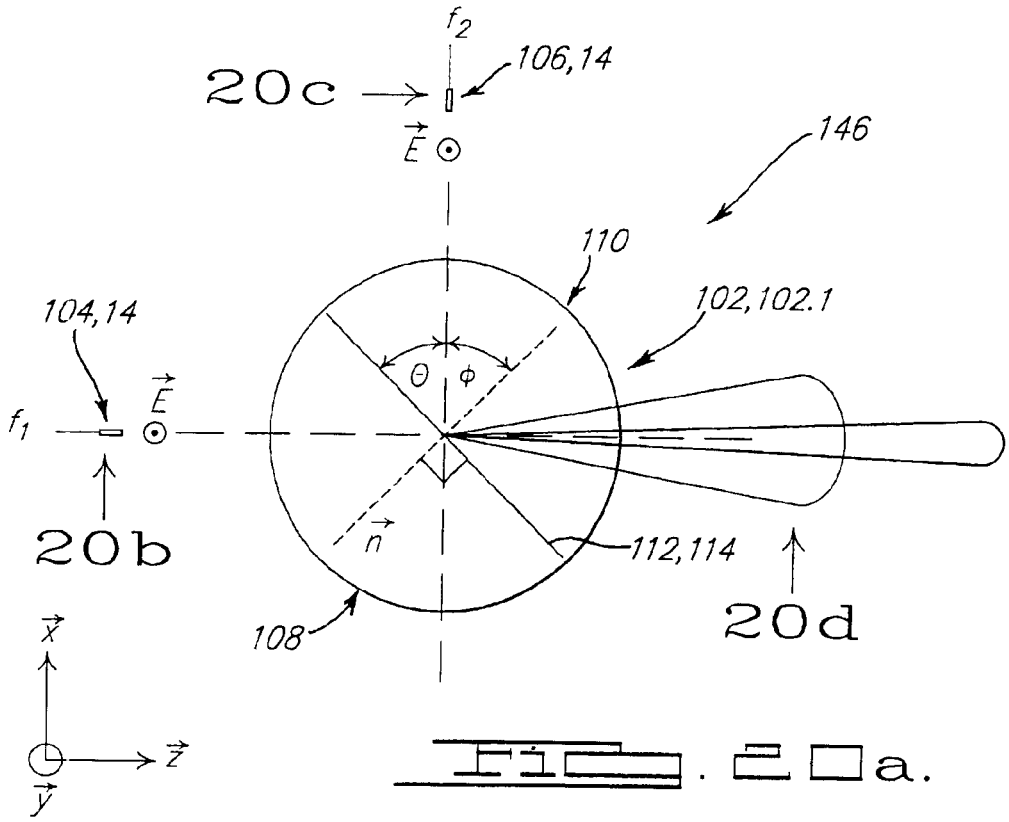
FIGS. 20*a*, 20*b*, 20*c* and 20*d* illustrates an eleventh embodiment of a multi-beam antenna incorporating the first embodiment of the selective element.
Figure 20B:
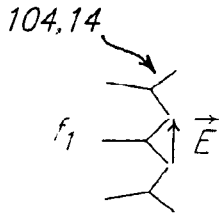
Figure 20C:
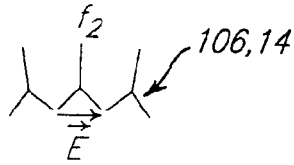
Figure 20D:
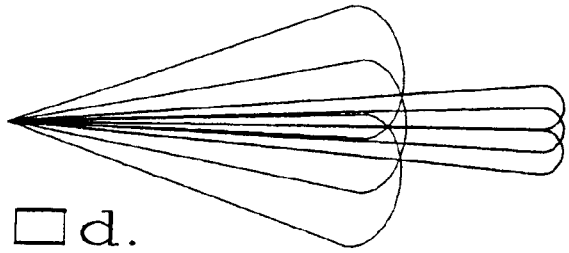

Referring to FIG. 19, in accordance with a tenth embodiment, a multi-beam antenna 144 is adapted for improved performance, resulting in an offset angle of about 25 degrees for the frequency selective surface 114 illustrated in FIG. 13, for a first carrier frequency $f_1$ of 77 GHz, and a second carrier frequency $f_2$ of 24 GHz.

Referring to FIG. 20, in accordance with an eleventh embodiment, a multi-beam antenna 146 comprises a frequency selective surface 114 oriented orthogonal to that illustrated in FIG. 18, wherein the associated plurality of first antenna feed elements 104, 14 and the associated plurality of second antenna feed elements 106,14 are each orthogonal to the respective orientations illustrated in FIG. 18. More particularly, the plurality of first antenna feed elements 104, 14 are oriented substantially in the y-z plane, and the plurality of second antenna feed elements 106, 14 are oriented substantially in the x-y plane, so that the plurality of first antenna feed elements 104, 14 and the plurality ofsecond antenna feed elements 106, 14 are each substantially perpendicular to the x-z plane.

The multi-beam antenna 100 can be used to either transmit or receive electromagnetic waves. In operation, a first electromagnetic wave is transmitted or received along a first direction through an first portion 108 of an electromagnetic lens 102, and a second electromagnetic wave is transmitted or received through a second portion 110 of the electromagnetic lens 102. A substantial portion of the second electromagnetic wave is reflected from a selective element 112 in a region between the first 108 and second 110 portions of the electromagnetic lens 102. The operations of transmitting or receiving a second electromagnetic wave through a second portion 110 of the electromagnetic lens 102 and reflecting the second electromagnetic wave from the selective element 112 in a region between the first 108 and second portion 110 of the electromagnetic lens 102 are adapted so that both the first and second electromagnetic waves propagate along a similar median direction within the second portion 110 of the electromagnetic lens 102, and the selective element 112 transmits the first electromagnetic wave and reflects the second electromagnetic wave responsive to either a difference in carrier frequency or a difference in polarization of the first and second electromagnetic waves.

Accordingly, the multi-beam antenna 100, 128, 132, 136, 144 or 146 provides for using a common electromagnetic lens 102 to simultaneously focus electromagnetic waves having two different carrier frequencies $f_1$, $f_2$, thereby providing for different applications without requiring separate associated apertures, thereby providing for a more compact overall package size. One particular application of the multi-beam antenna 100, 128, 132, 136, 144 or 146 is for automotive radar for which 24 GHz radiation would be used for relatively near range, wide field of view, collision avoidance applications, as well as stop and go functionality and parking aid, and 77 GHz radiation would be used for long range autonomous cruise control applications. Using the same aperture provides for substantially higher gain and narrower beamwidths for the shorter wavelength 77 GHz radiation, hence allowing long range performance. The 24 GHz radiation would, on the other hand, present proportionally wider beamwidths and lower gain, suitable for wider field of view, shorter range applications.

Figure 21:
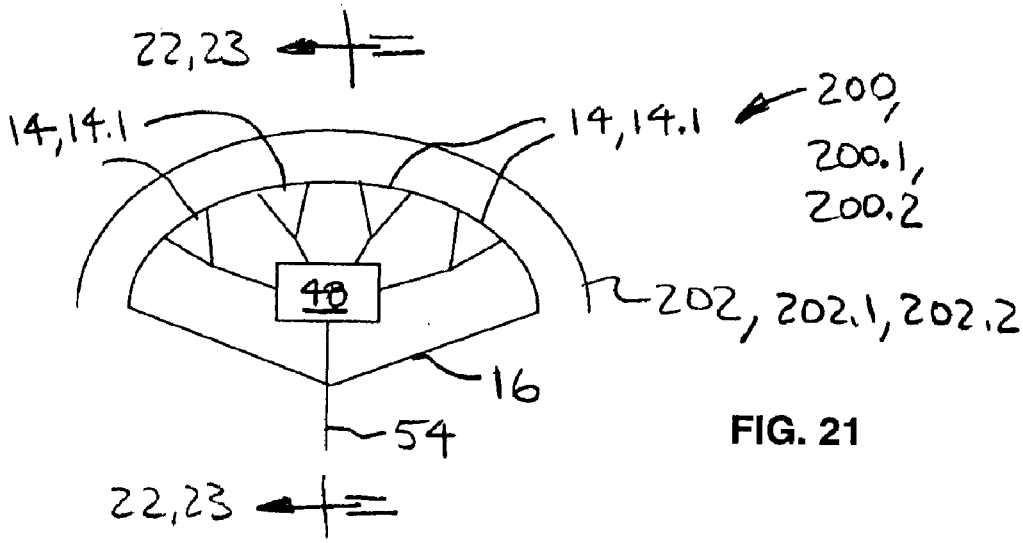
FIG. 21 illustrates a twelfth embodiment of a multi-beam antenna incorporating a curved reflective surface.

Referring to FIG. 21, in accordance with a sixth aspect and a twelfth embodiment embodiment, a multi-beam antenna 200 comprises a curved reflective surface 202 and a dielectric substrate 16 upon which are located a plurality of antenna feed elements 14, e.g. end-fire antenna elements 14.1. The dielectric substrate 16 is located on the concave side of the curved reflective surface 202, and is shaped so as to provide for a cooperation of the antenna feed elements 14 with the concave side of the curved reflective surface 202. The antenna feed elements 14 are adapted to launch associate electromagnetic waves towards the concave side of the curved reflective surface 202, for example, substantially co-incident or aligned with a radius of curvature of the curved reflective surface 202. These electromagnetic waves are reflected by thecurved reflective surface 202, which then acts similar to the electromagnetic lens 12 of the above-described embodiments to focus the associated electromagnetic waves into associated beams, except that for the twelfth embodiment embodiment, a multi-beam antenna 200, the electromagnetic waves are reflected an propagate over the dielectric substrate 16, whereas in the above described embodiments using an electromagnetic lens 12, the associated electromagnetic waves continue to propagate away from the dielectric substrate 16 after propagating through the electromagnetic lens 12. Otherwise, the materials and construction of the antenna feed elements 14 on the dielectric substrate 16, and the manner by which the associated signals are coupled to the antenna feed elements 14, is similar to that described herein-above, particularly in conjunction with FIGS. 1 and 2. For example, the antenna feed elements 14 can be etched into an appropriate printed circuit material, so as to provide for launching associated electromagnetic waves off the edge of the associated substrate. For example, as illustrated in FIG. 21, the antenna feed elements 14 are operatively coupled to an associated switching network 48, which is operatively coupled to an associated corporate antenna feed port 54. In the embodiment illustrated in FIG. 21, the curved reflective surface 202 is substantially circular in a cross section along the intersection with a reference surface that is parallel to the dielectric substrate 16 along the plurality of antenna feed elements 14.

Figure 22:
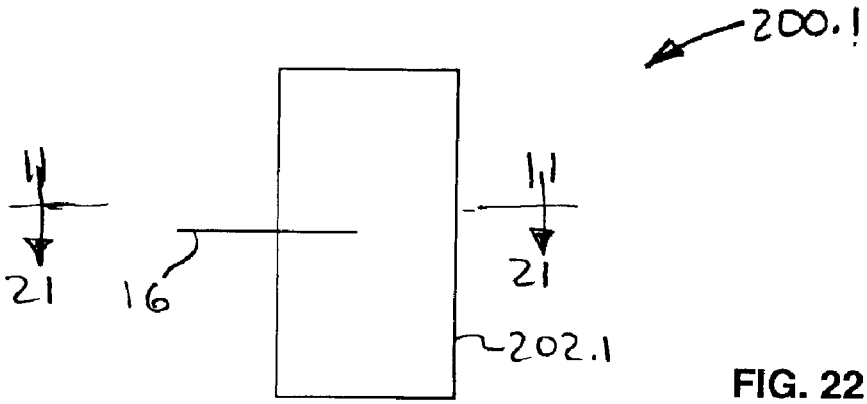
FIG. 22 illustrates a thirteenth embodiment of a multi-beam antenna incorporating a cylindrical curved reflective surface.

Referring to FIG. 22, in accordance with a thirteenth embodiment of a multi-beam antenna 200.1, the curved reflective surface 202.1 is cylindrical, so that the associated multi-beam antenna 200.1 provides for focusing the associated electromagnetic waves along a direction parallel to the dielectric substrate 16, but not along a direction orthogonal thereto.

Figure 23:
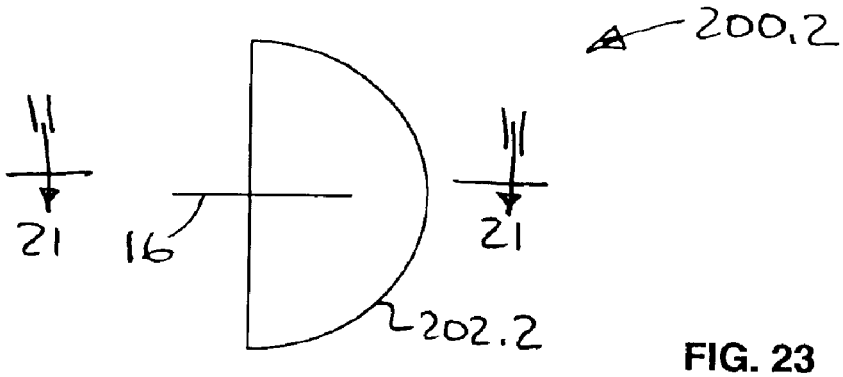
FIG. 23 illustrates a fourteenth embodiment of a multi-beam antenna incorporating a curved reflective surface having a circular cross-section in the plane of the dielectric substrate and a parabolic cross-section normal to the plane of the dielectric substrate.

Referring to FIG. 23, in accordance with a fourteenth embodiment of a multi-beam antenna 200.2, the curved reflective surface 202.2 has a parabolic cross-section along a direction normal to the dielectric substrate 1, so that the associated multi-beam antenna 200.2 provides for focusing the associated electromagnetic waves along both a direction parallel to the dielectric substrate 16, and along a direction normal thereto.

Figure 24:
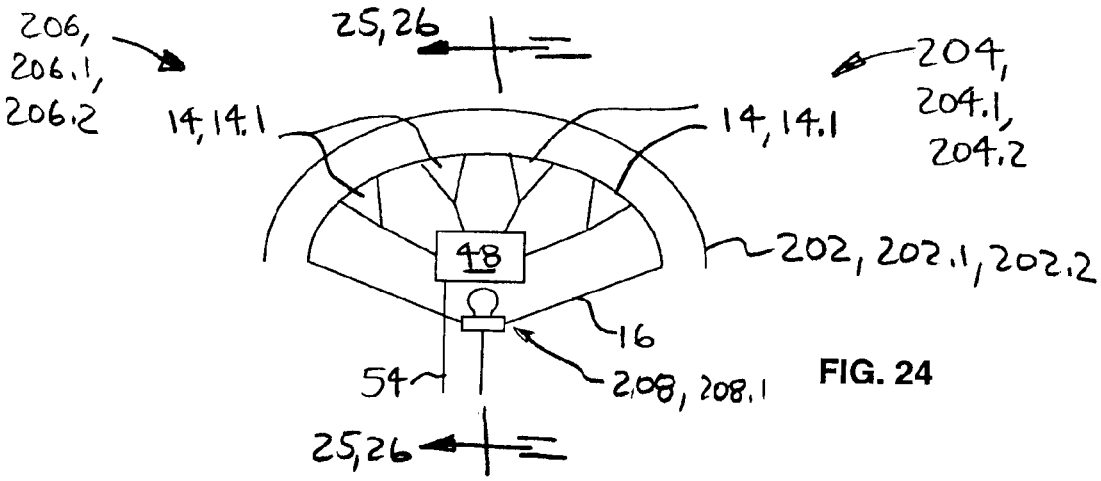
FIG. 24 illustrates a fifteenth embodiment of a multi-beam antenna incorporating a curved optical reflector, and a light source that is operatively associated with a dielectric substrate.
Figure 25:
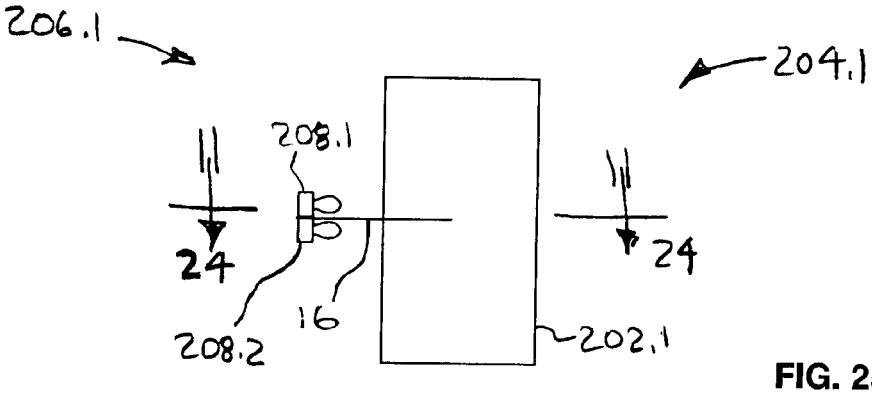
FIG. 25 illustrates a sixteenth embodiment of a multi-beam antenna incorporating a cylindrical curved optical reflector, and a plurality of light sources that are operatively associated with a dielectric substrate.
Figure 26:
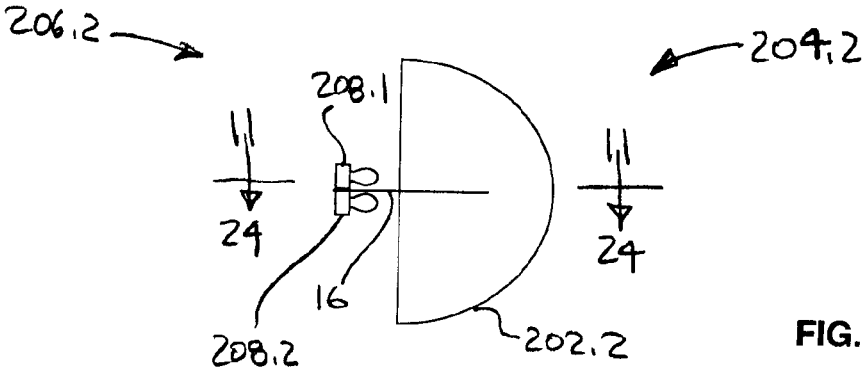
FIG. 26 illustrates a seventeenth embodiment of a multi-beam antenna incorporating curved reflector having a circular cross-section in the plane of the dielectric substrate and a parabolic cross-section normal to the plane of the dielectric substrate, and a plurality of light sources that are operatively associated with a dielectric substrate.

Referring to FIGS. 24,25 and 26, in accordance with a seventh aspect and associated fifteenth, sixteenth and seventeenth embodiments, the associated multi-beam antennas 204,204.1 and 204.2 are similar to the corresponding twelfth, thirteenth and fourteenth embodiments described hereinabove, except that each is incorporated in an associated light assembly 206, 206.1, 206.2 comprising a least one source of light 208,208.1,208.2, wherein the associated curved reflective surfaces 202,202.1 and 202.2 function to reflect both the electromagnetic waves generated by the associated antenna feed elements 14, and the light generated by the a least one source of light 208,208.1,208.2. More particularly, the dielectric substrate 16 is adapted so as to be operatively associated with the associated a least one source of light 208,208.1,208.2, e.g. the a least one source of light 208,208.1, 208.2 may be operatively coupled thereto so as to synchronize the alignment of the a least one source of light 208, 208.1,208.2 and the associated plurality of antenna feed elements 14, the combination of which can then be jointly adjusted relative to the associated at least one curved reflective surface 202,202.1 and 202.2 so as to provide for aligning both the set of electromagnetic beams and the light beam(s).

Accordingly, the embodiments fifteenth, sixteenth and seventeenth embodiments illustrated in FIGS. 24,25 and 26 provide for a synergistic cooperation of a multi-beam electromagnetic antenna with a light source, both of which share a common curved reflective surface 202,202.1 and 202.2, and an associated common packaging, e.g. either open or sealed, depending upon the particular application.

Figure 27:
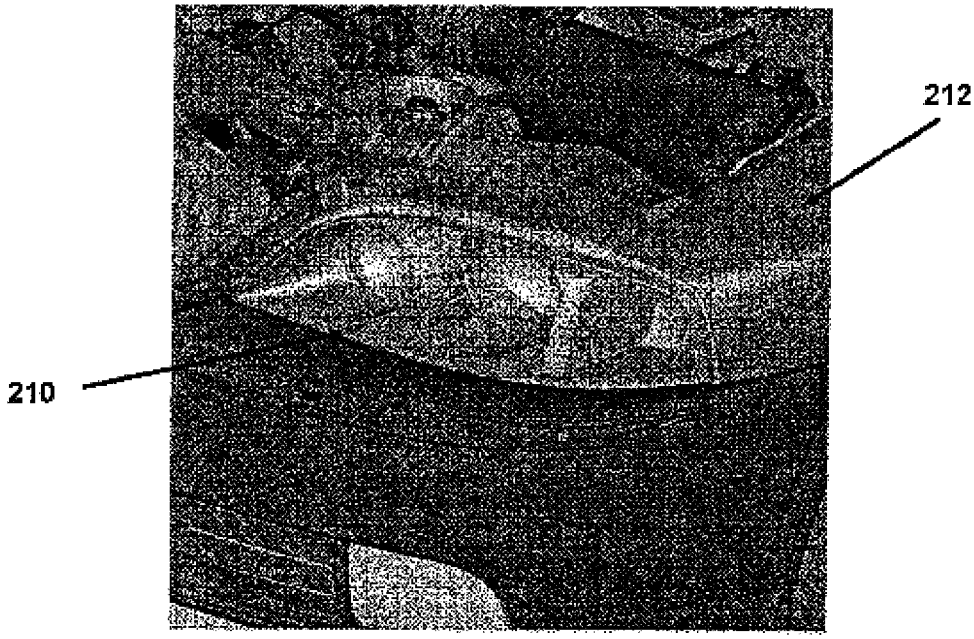
FIG. 27 illustrates a headlight assembled in vehicle.
Figure 28:
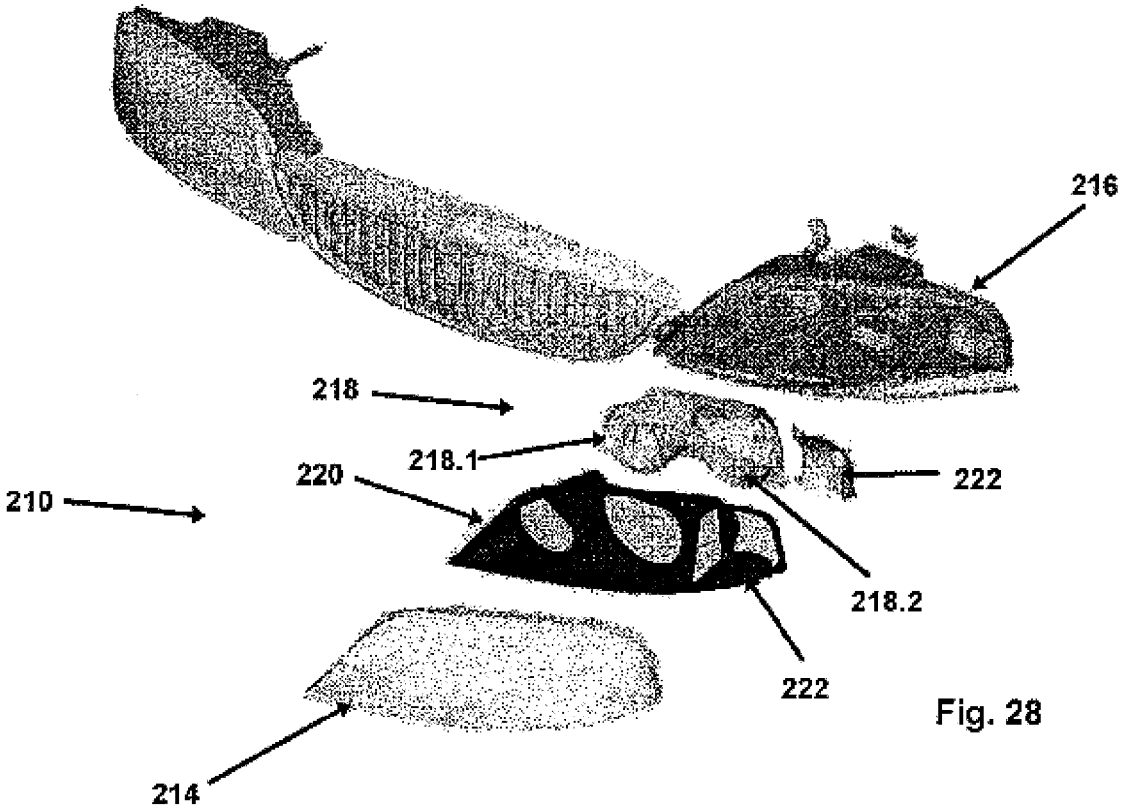
FIG. 28 illustrates an exploded view of a vehicle headlight assembly.

For example, referring to FIGS. 27 and 28, the multi-beam antenna 204.2 and light assembly 206.2 illustrated in FIG. 26 is useful in an automotive environment, so as to provide for packaging a multi-beam radar antenna within a headlight assembly 210, or another light assembly, e.g. a tail light assembly (not illustrated), in the front or rear of the vehicle 212, respectively. The spherical/circular shape of the curved reflective surface 202.2 in the horizontal/azimuthal direction, and parabolic shape in the vertical/elevation direction, provides for associated focusing of both the electromagnetic and optical beams in the respective directions. By packaging the multi-beam antenna 204.2 in a headlight assembly 210, the alignment of the multi-beam antenna 204.2 can be adjusted using the horizontal and vertical angular adjusters associated with the headlight assembly 210, e.g. without requiring a separate aligner for the dielectric substrate 16, thereby providing for the inherent alignment, and correction of misalignment, of the electromagnetic beams of from themulti-beam antenna 204.2. Co-locating the multi-beam antenna 204.2 and light assembly 206.2 thereby precludes the need to mount the multi-beam antenna in an otherwise disadvantageous location, e.g. in front of a radiator which could block cooling flow or limit the acceptable size of the multi-beam antenna or impose a relatively harsh thermal environment or within a bumper or bumper fascia which might otherwise require undesirable cutouts in associated structural or aesthetic body elements, or might otherwise adversely affect the propagation of the associated electromagnetic waves or the associated beam or sidelobe patterns. Furthermore, a typical headlight lens 214 is constructed from a polycarbonate material which has relatively low losses at common automotive radar frequencies (e.g. 24 and 77 GHz), thereby providing a radome for the multi-beam antenna 204.2 without substantially adversely affecting the performance of the multi-beam antenna 204.2.

Referring to FIG. 26, first 208.1 and second 208.2 sources of light, e.g. incandescent or halolgen bulbs, or LED emitters, are located on either side of the dielectric substrate 16 substantially near the parabolic focus of the associated curved reflective surface 202.2, so that light from the first 208.1 and second 208.2 sources of light can reach both the upper and lower portions of the curved reflective surface 202.2, and thereby be focused in the elevation direction, while also being substantially focused in the azimuthal direction, thereby creating a light beam that is somewhat fan shaped in azimuth and well focused in elevation. The light beam focusing could be adjusted by changing the exact placement of the first 208.1 and second 208.2 sources of light. The dielectric substrate 16 be made relatively thin (e.g. on the order of 15 mils) so as to not substantially block the associated light beam. Furthermore, millimeter wave components—which have a relatively small cross-section—can also be placed on the substrate without adversely affecting the light beam. Alternately, a single source of light 208 might be located within an opening in the dielectric substrate 16 so as to illuminate the curved reflective surface 202.2 from both sides of the dielectric substrate 16.

Referring to FIGS. 27 and 28, the headlight assembly 210 comprises a housing 216, reflector assembly 218, inner bezel 220 and headlight lens 214. In one embodiment, the multi-beam antenna 202.2 can be integrated with one of the headlight reflectors 218.1 (e.g. inboard) of the reflector assembly 218, with the remaining headlight reflector 218.2 providing for both high and low headlight beams. Alternately, the multi-beam antenna 204.2 can be integrated with the associated headlight in either or both of the associated headlight reflectors 281.1, 218.2. Furthermore, a relatively wide field-of-view multi-beam antenna 204.2 can be integrated with the side lamp reflector 222 at a corner of the vehicle 212. In combination with a similar multi-beam antenna 204.2 at the rear corner of the vehicle 212, this would provide for frontal, rear and side coverage.

It should be understood, that the embodiments incorporating curved reflective surfaces are not limited to the concavecurved reflective surfaces 202, 202.1, 202.2 described hereinabove. For example, the convex reflective surfaces can also be utilized, either alone, or in combination with other reflective surfaces, either planar or curved. For example, in the embodiment of FIG. 1, the electromagnetic lens 12 could be replaced with a spherical reflective surface, which would reflect the electromagnetic waves back over the dielectic substrate 16. A concave curved reflective surface partially surrounding the convex curved reflective surface to then reflect the electromagnetic waves back towards the directions illustrated in FIG. 1, thereby providing for a multi-beam antenna embodiment that functions similar to the embodiment illustrated in FIG. 1, without requiring an electromagnetic lens.

While specific embodiments have been described in detail in the foregoing detailed description and illustrated in the accompanying drawings, those with ordinary skill in the art will appreciate that various modifications and alternatives to those details could be developed in light of the overall teachings of the disclosure. Accordingly, the particular arrangements disclosed are meant to be illustrative only and not limiting as to the scope of the invention, which is to be given the full breadth of the appended claims and any and all equivalents thereof.

What is claimed is:

1. A multi-beam antenna, comprising:

a. at least one curved surface;

b. at least one dielectric substrate; and c. a plurality of antenna feed elements on said dielectric substrate, wherein at least two of said plurality of antenna feed elements each comprise an end-fire antenna element adapted to launch electromagnetic waves in a direction substantially towards said at least one curved surface, and said direction for at least one said end-fire antenna element is different from said direction for at least another said end-fire antenna element.

2. A multi-beam antenna as recited in claim 1, wherein at least one of said at least one curved surface is adapted to substantially reflect at least some of said electromagnetic waves.

3. A multi-beam antenna as recited in claim 1, wherein at least one of said at least one curved surface is metallic.

4. A multi-beam antenna as recited in claim 1, wherein at least one of said at least one curved surface is substantially circular in a first cross section along an intersection with a reference surface parallel to said dielectric substrate along said plurality of antenna feed elements.

5. A multi-beam antenna as recited in claim 4, wherein at least one of said at least one curved surface is substantially parabolic in a second cross section that is substantially normal to said first cross section.

6. A multi-beam antenna as recited in claim 1, wherein at least one of said at least one curved surface is substantially spherical.

7. A multi-beam antenna as recited in claim 1, wherein at least one of said at least one curved surface is substantially cylindrical.

8. A multi-beam antenna as recited in claim 1, wherein at least one of said at least one curved surface comprises an optical reflector.

9. A multi-beam antenna as recited in claim 8, wherein said optical reflector comprises a reflector of a light assembly.

10. A multi-beam antenna as recited in claim 9, wherein said at least one dielectric substrate is located within said light assembly.

11. A multi-beam antenna as recited in claim 10, wherein said at least one dielectric substrate is adapted to operatively associate with at least one source of light of said light assembly.

12. A multi-beam antenna as recited in claim 11, wherein said at least one source of light comprises a plurality of sources of light, and at least two of said plurality of sources of light are operatively associated with different sides of said at least one dielectric substrate.

13. A multi-beam antenna as recited in claim 9, wherein said light assembly comprises a vehicle headlight assembly.

14. A multi-beam antenna as recited in claim 1, wherein at least one of said at least one curved surface is substantially refractive of at least some of said electromagnetic waves.

15. A multi-beam antenna as recited in claim 1, wherein at least one of said at least one curved surface is substantially diffractive of at least some of said electromagnetic waves.

16. A multi-beam antenna as recited in claim 1, wherein at least one of said at least one curved surface is dielectric.

17. A multi-beam antenna as recited in claim 1, wherein at least one of said at least one curved surface is a surface of an electromagnetic lens.

18. A multi-beam antenna as recited in claim 1, wherein said direction of at least one said end-fire antenna element is substantially aligned with a radius of curvature of said at least one curved surface.

19. A multi-beam antenna as recited in claim 18, wherein said direction of at least one said end-fire antenna element is substantially co-incident with saidadius of curvature of said at least one curved surface.

20. A multi-beam antenna as recited in claim 19, wherein said dielectric substrate comprises a dielectric of a printed circuit.

21. A multi-beam antenna as recited in claim 1, whereind each said antenna feed element comprises a least one conductor operatively connected to said dielectric substrate.

22. A multi-beam antenna as recited in claim 1, wherein said at least one dielectric substrate is substantially planar.

23. multi-beam antenna as recited in claim 1, wherein said end-fire antenna is selected from a Yagi-Uda antenna, a coplanar horn antenna, a Vivaldi antenna, a tapered dielectric rod, a slot antenna, a dipole antenna, and a helical antenna.

24. multi-beam antenna as recited in claim 1, further comprising at least one transmission line on said dielectric substrate, wherein at least one said at least one transmission line is operatively connected to a feed port of one of said plurality of antenna feed elements.

25. multi-beam antenna as recited in claim 24, wherein said transmission line is selected from a stripline, a microstrip line, an inverted microstrip line, a slotline, an image line, an insulated image line, a tapped image line, a coplanar stripline, and a coplanar waveguide line.

26. multi-beam antenna as recited in claim 24, further comprising a switching network having an input and a plurality of outputs, said input is operatively connected to a corporate antenna feed port, and each output of said plurality of outputs is connected to a different antenna feed element of said plurality of antenna feed element via said at least one transmission line.

27. multi-beam antenna as recited in claim 1, further comprising a switching network having an input and a plurality of outputs, said input is operatively connected to a corporate antenna feed port, and each output of said plurality of outputs is connected to a different antenna feed element of said plurality of antenna feed elements.

28. multi-beam antenna as recited in claim 27, wherein said switching network is operatively connected to said dielectric substrate.

* * * * *